US010076782B2

(12) United States Patent
Cho et al.

(10) Patent No.: US 10,076,782 B2
(45) Date of Patent: Sep. 18, 2018

(54) METAL FIBER MANUFACTURING SYSTEM

(71) Applicant: POSCO, Pohang-si, Gyeongsangbuk-do (KR)

(72) Inventors: Un-Kwan Cho, Pohang-si (KR); Goo-Hwa Kim, Pohang-si (KR); Chul-Sung Jang, Pohang-si (KR); Byung-Il Kim, Pohang-si (KR)

(73) Assignee: POSCO, Pohang-si, Gyeongsangbuk-Do (KR)

( * ) Notice: Subject to any disclaimer, the term of this patent is extended or adjusted under 35 U.S.C. 154(b) by 0 days.

(21) Appl. No.: 15/327,458

(22) PCT Filed: Dec. 1, 2014

(86) PCT No.: PCT/KR2014/011641

§ 371 (c)(1),
(2) Date: Jan. 19, 2017

(87) PCT Pub. No.: WO2016/013729

PCT Pub. Date: Jan. 28, 2016

(65) Prior Publication Data

US 2017/0165744 A1 Jun. 15, 2017

(30) Foreign Application Priority Data

Jul. 21, 2014 (KR) ..... 10-2014-0091742
Jul. 21, 2014 (KR) ..... 10-2014-0091743
(Continued)

(51) Int. Cl.
*B22D 11/00* (2006.01)
*B22D 11/06* (2006.01)
(Continued)

(52) U.S. Cl.
CPC ..... *B22D 11/00* (2013.01); *B22D 11/06* (2013.01); *B26D 1/36* (2013.01); *B02C 23/08* (2013.01); *B21F 23/00* (2013.01); *B65B 57/10* (2013.01)

(58) Field of Classification Search
CPC ..... B22D 11/00; B22D 11/06; B22D 11/0611; B22D 11/0614; B22D 11/0617; B22D 11/0631; B22D 11/0634
See application file for complete search history.

(56) References Cited

U.S. PATENT DOCUMENTS 4,736,493 A 4/1988 Haass-Zollick et al.
5,213,151 A * 5/1993 Hackman ..... B22D 11/0611 164/154.2
7,156,150 B2 1/2007 Zahedi et al.

FOREIGN PATENT DOCUMENTS

JP 7-006094 B2 1/1995
JP H09-173996 A 7/1997
(Continued)

OTHER PUBLICATIONS

Extended European Search Report dated Apr. 4, 2017 issued in European Patent Application No. 14898030.3.
(Continued)

*Primary Examiner* — Kevin P Kerns
*Assistant Examiner* — Steven S Ha
(74) *Attorney, Agent, or Firm* — McDermott Will & Emery LLP

(57) ABSTRACT

The present invention relates to a metal fiber manufacturing system. The system casts molten metal as a metal fiber; collects the metal fiber in real time; transfers the metal fiber; separates normal products from defective products; and packages a predetermined amount of the normal product metal fiber. The system processes the cast metal fiber continuously or in batches, and manufactures the same, thereby having effects of improving the efficiency of the production process and obtaining significant economic benefits.

18 Claims, 18 Drawing Sheets

(30) Foreign Application Priority Data

| | | |
|---|---|---|
| Aug. 28, 2014 | (KR) | 10-2014-0113253 |
| Sep. 25, 2014 | (KR) | 10-2014-0128266 |
| Oct. 8, 2014 | (KR) | 10-2014-0136073 |

(51) Int. Cl.

| | |
|---|---|
| ***B26D 1/36*** | (2006.01) |
| *B02C 23/08* | (2006.01) |
| *B21F 23/00* | (2006.01) |
| *B65B 57/10* | (2006.01) |

(56) References Cited

FOREIGN PATENT DOCUMENTS

| | | | |
|---|---|---|---|
| JP | 2001-162235 | A | 6/2001 |
| JP | 2004-306139 | A | 11/2004 |
| KR | 10-0402833 | B1 | 10/2003 |
| KR | 10-2006-0011852 | A | 2/2006 |
| KR | 10-0643654 | B1 | 11/2006 |
| KR | 10-0823878 | B1 | 4/2008 |
| KR | 10-2009-0034626 | A | 4/2009 |
| KR | 10-2011-0108970 | A | 10/2011 |
| KR | 10-2012-0074783 | A | 7/2012 |
| KR | 20-0464257 | Y1 | 1/2013 |
| KR | 10-2013-0027323 | A | 3/2013 |
| KR | 10-2013-0040988 | A | 4/2013 |
| KR | 10-1386446 | B1 | 4/2014 |

OTHER PUBLICATIONS

J. Daniel, et al., "State-of-the-Art Report on Fiber Reinforced Concrete," ACI Committee 44, American Concrete Institute, Nov. 18, 1996, vol. 1R-96, pp. 1-23.

F. Toutlemonde, et al., "Valorisation des betons a hautes et tres hautes perfomances dans les structures d'ouvrages d'art," Bulletin des laboratories des pants et chaussees, Laboratoire central Des Pants et Chaussees, Dec. 31, 2003, pp. 57-72 (with English Abstract).

International Search Report dated Apr. 8, 2015 issued in International Patent Application No. PCT/KR2014/011641 (with English translation) .

* cited by examiner

【Figure 1】
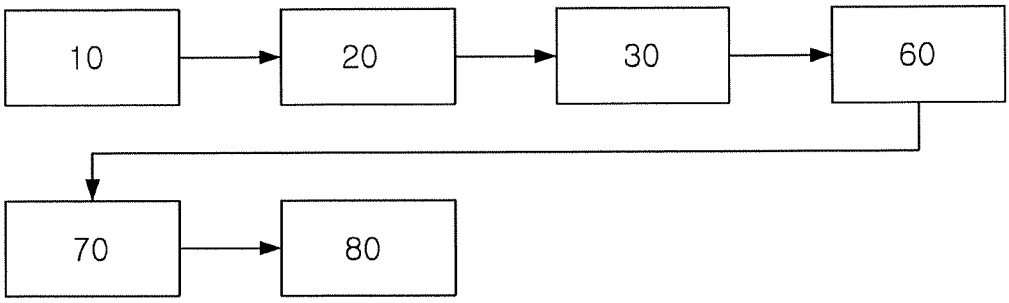
【Figure 2】
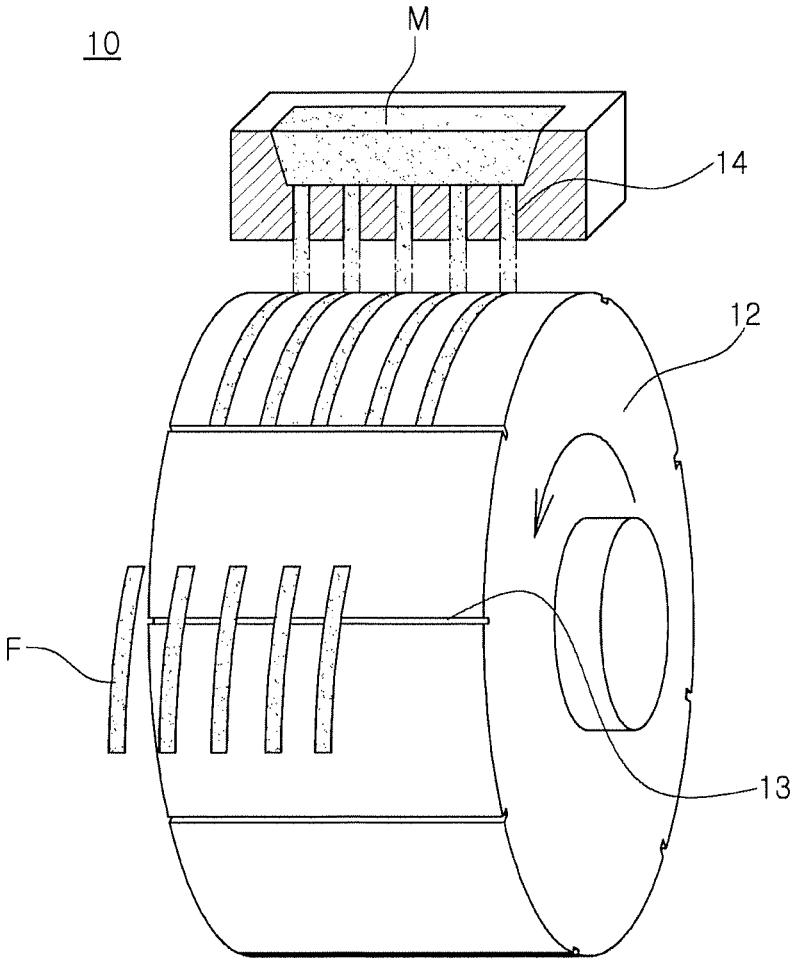

【Figure 3】
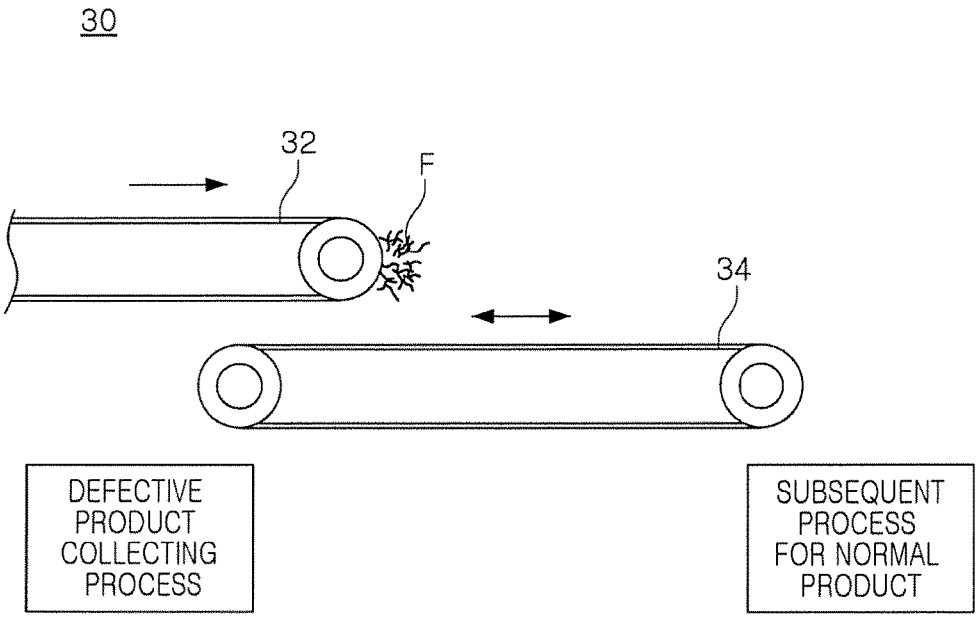
【Figure 4】
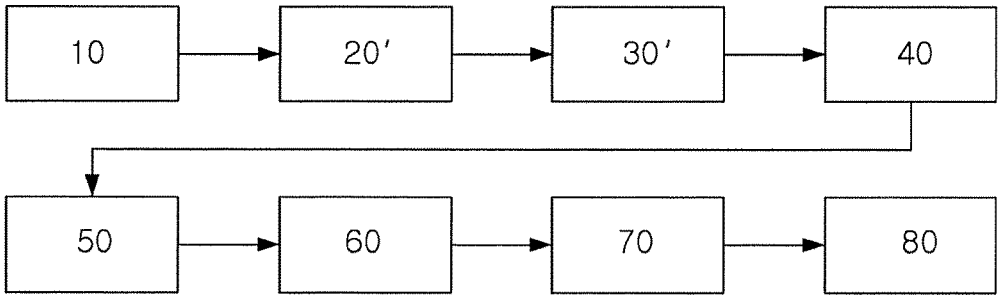

【Figure 5】
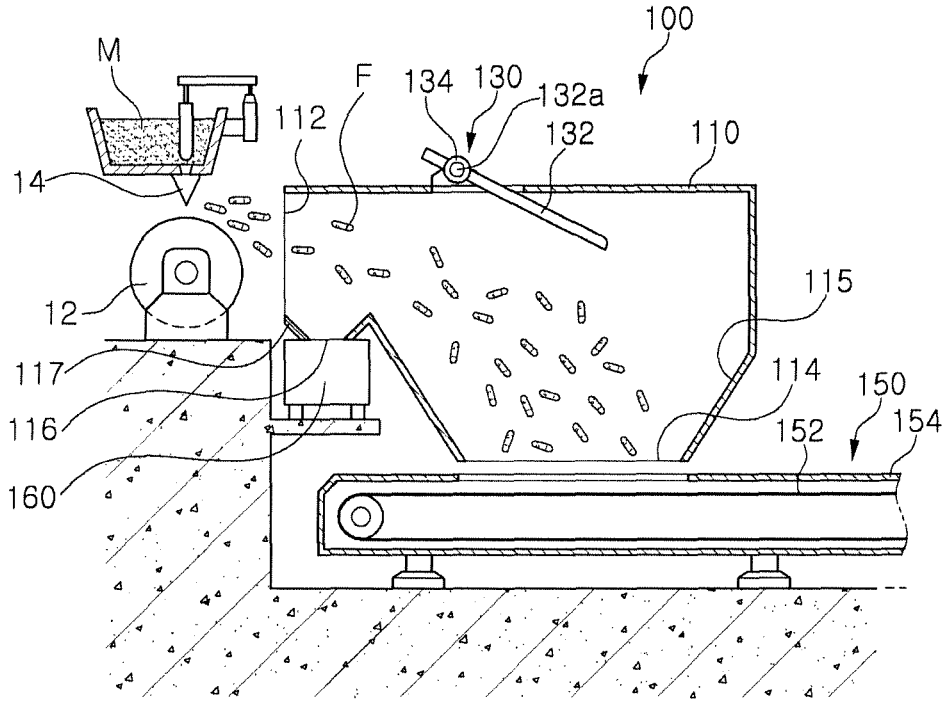

【Figure 6】
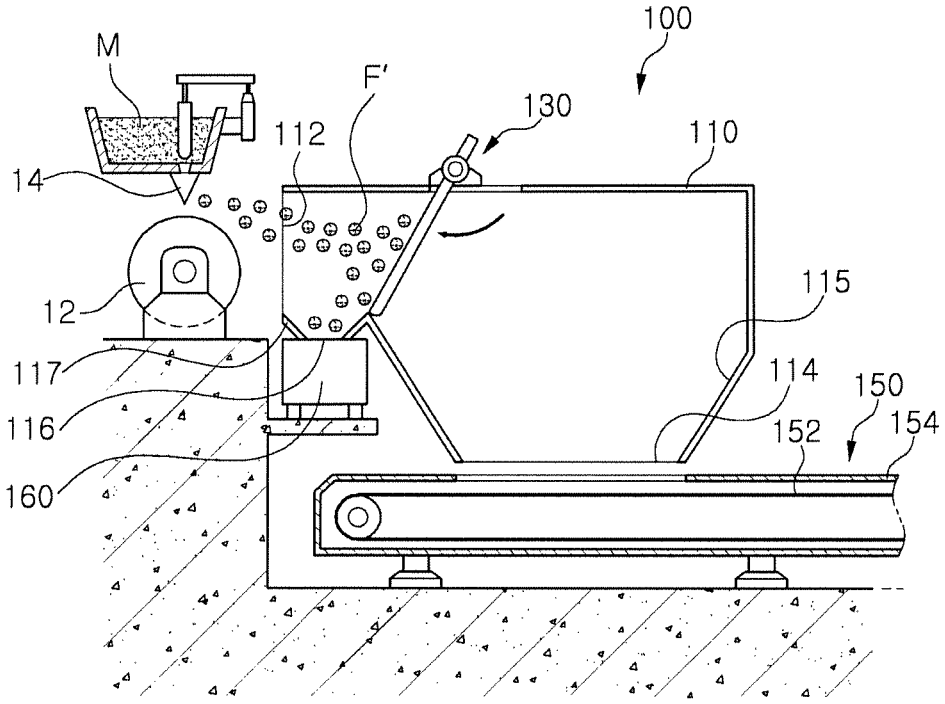

【Figure 7】
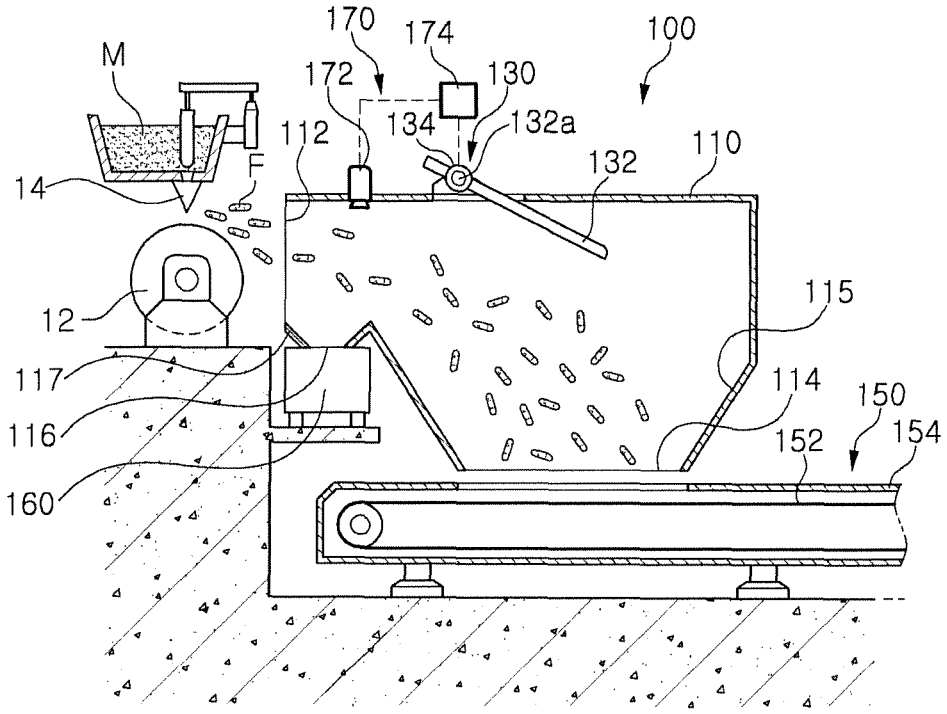

【Figure 8】
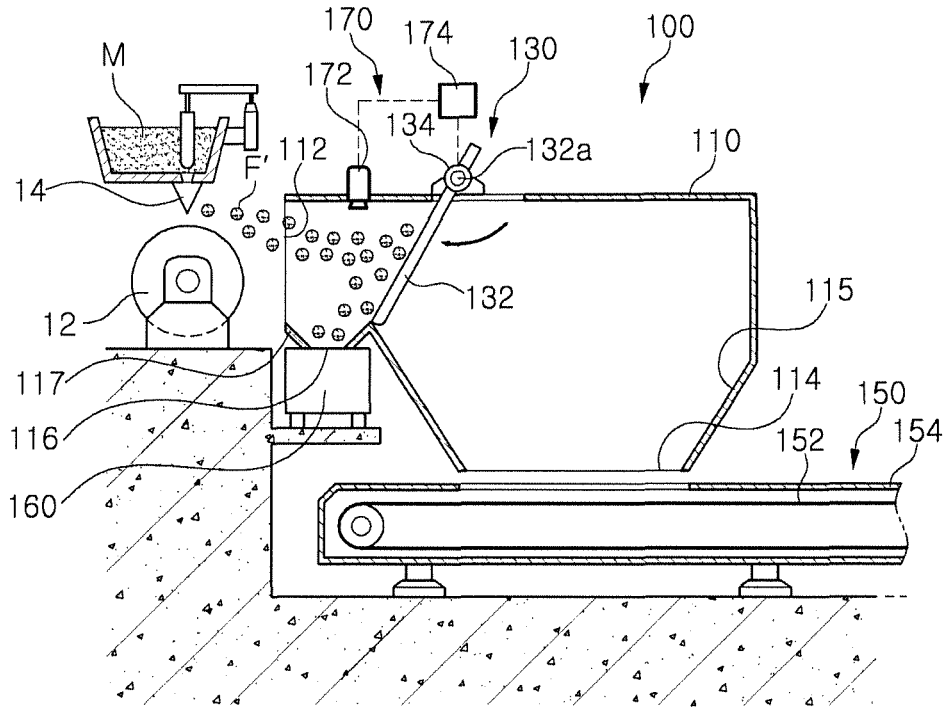

【Figure 9】
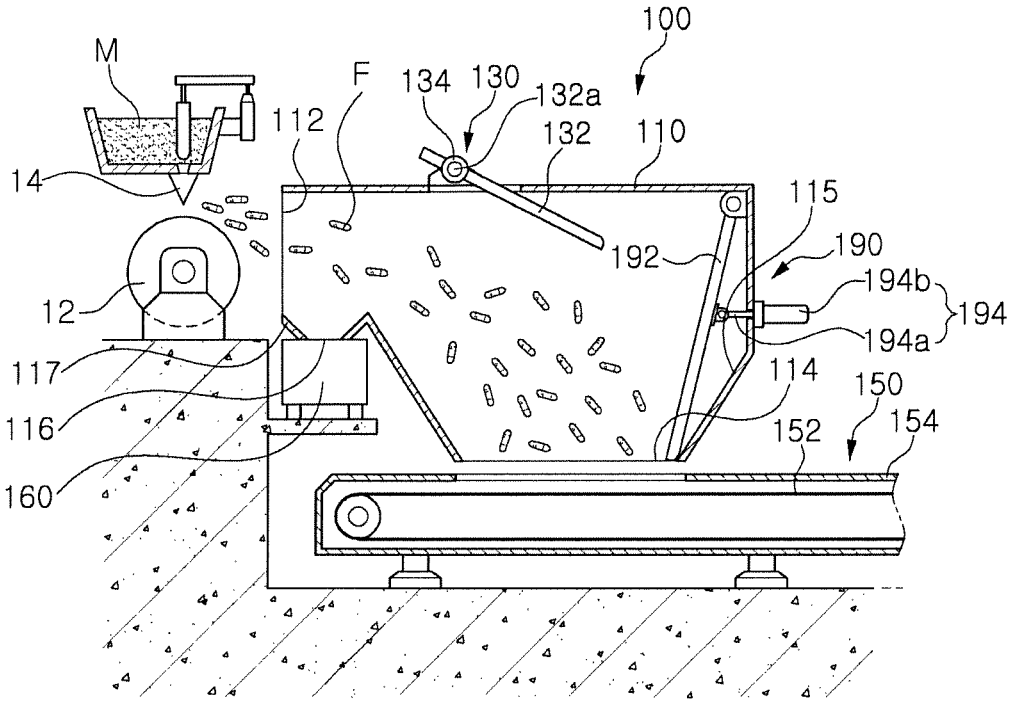

【Figure 10】
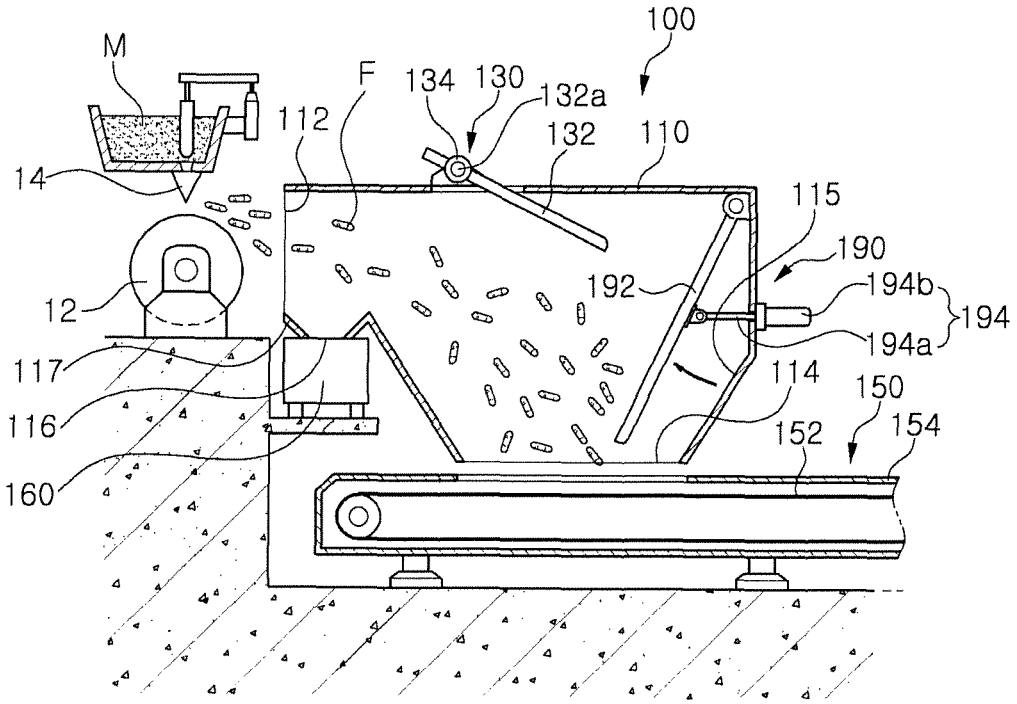

【Figure 11】
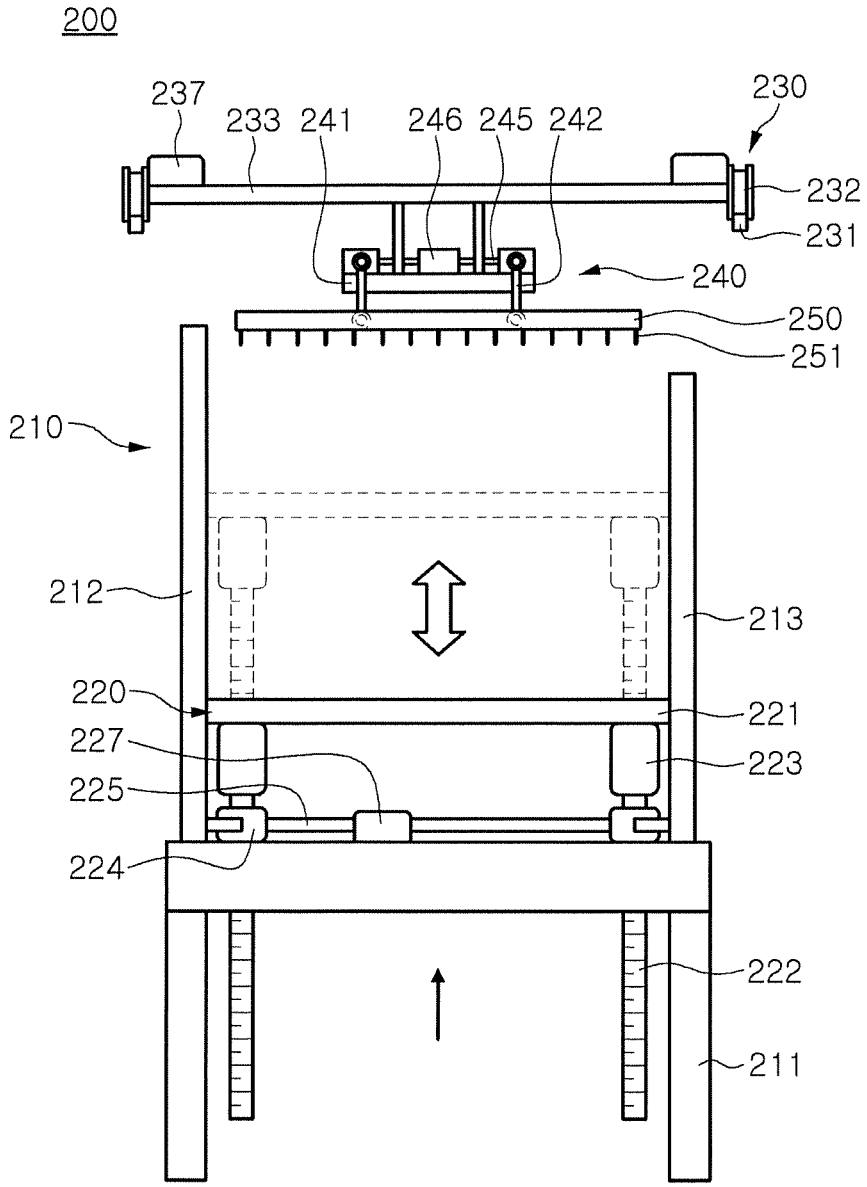

【Figure 12】
220
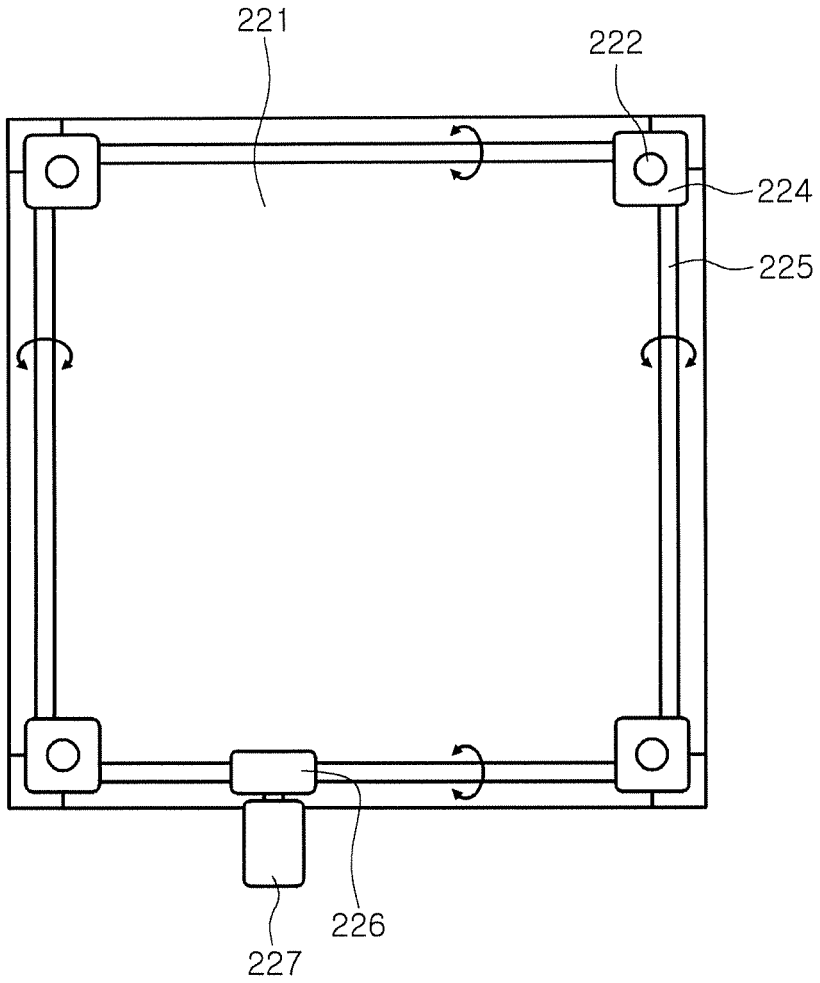

【Figure 13】
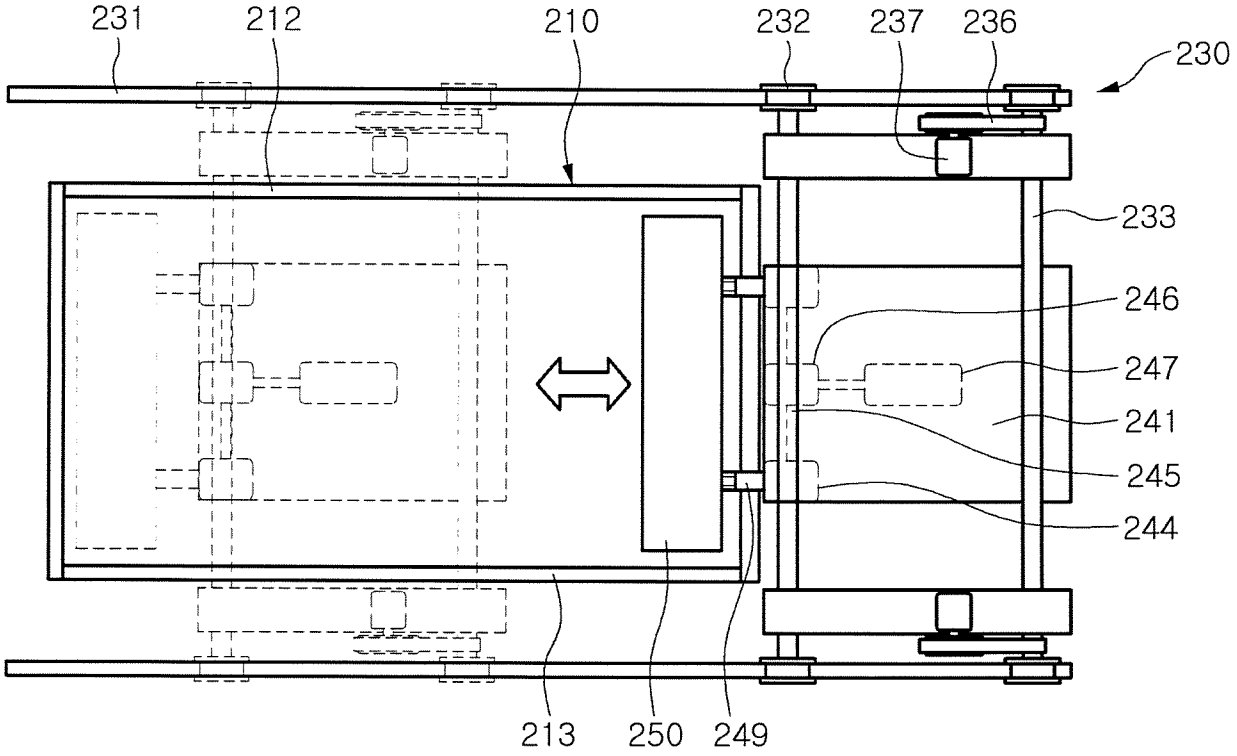

【Figure 14】
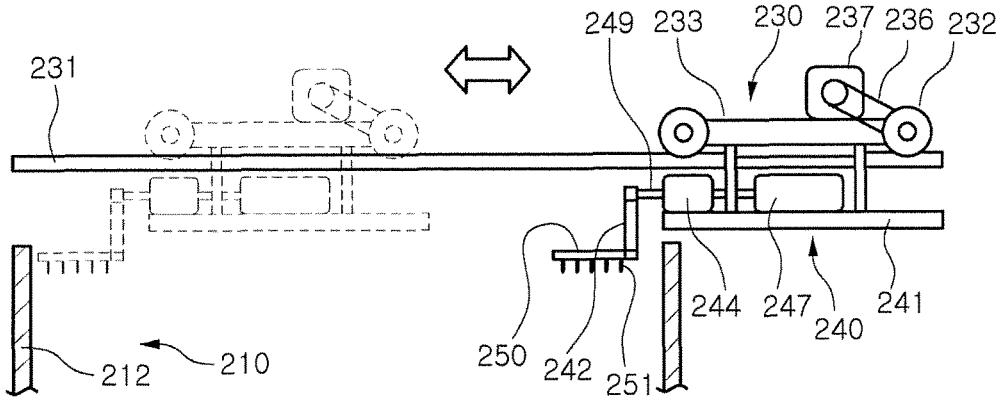
【Figure 15】
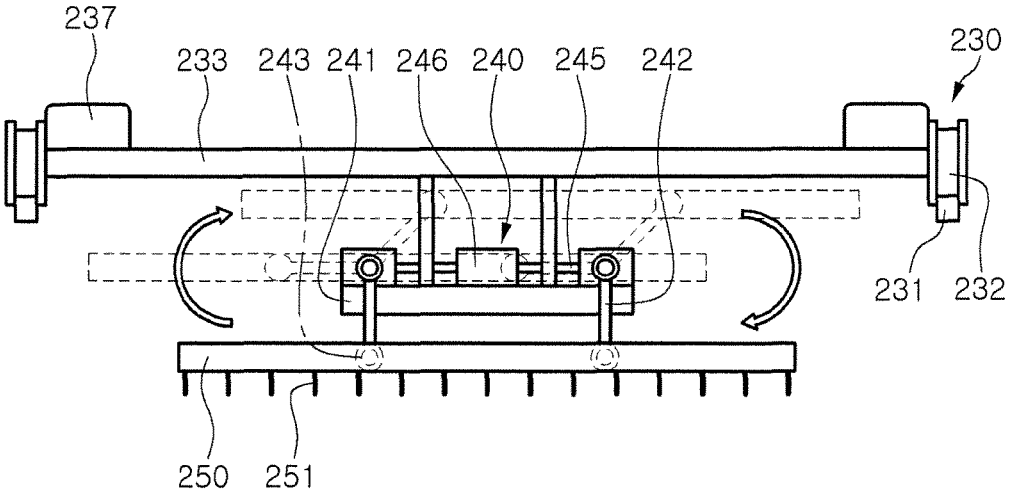

【Figure 16】
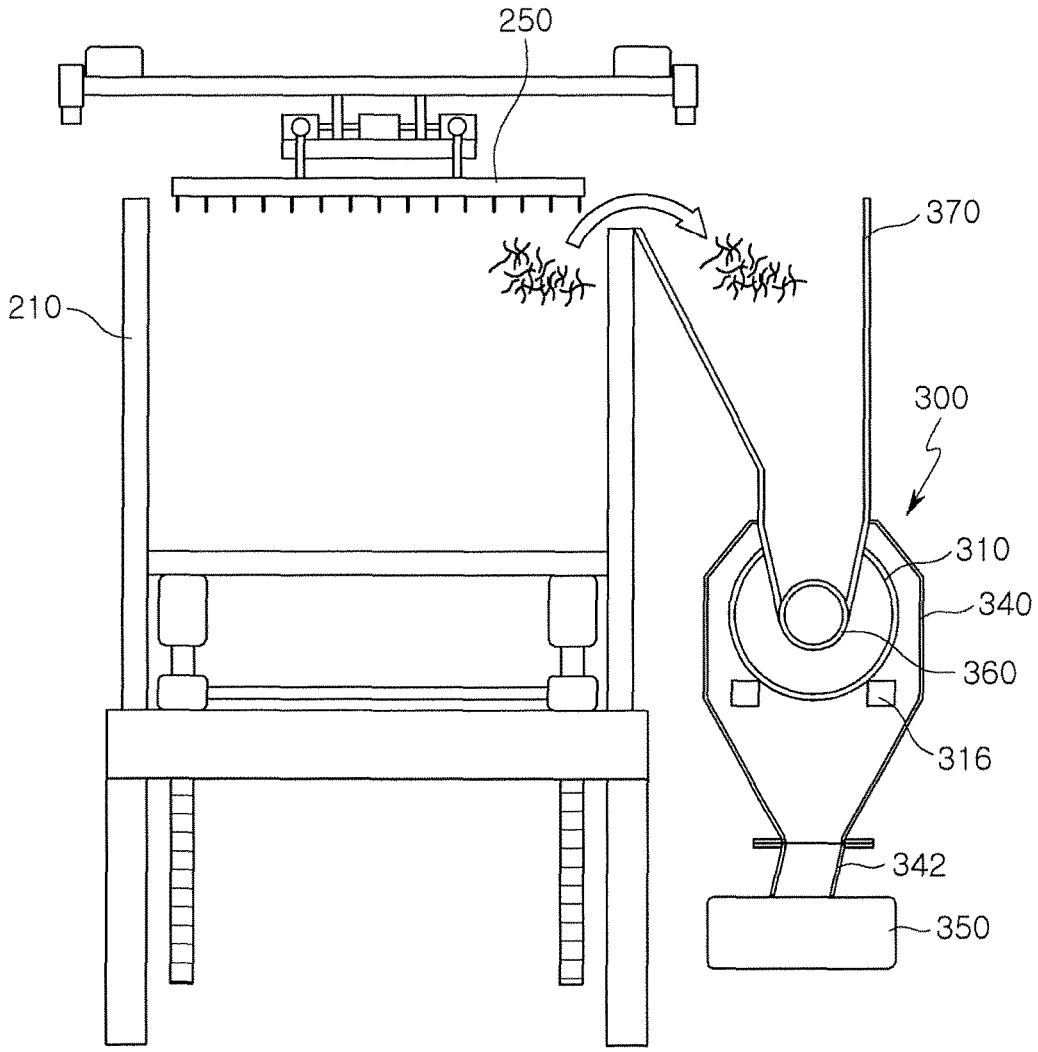

【Figure 17】
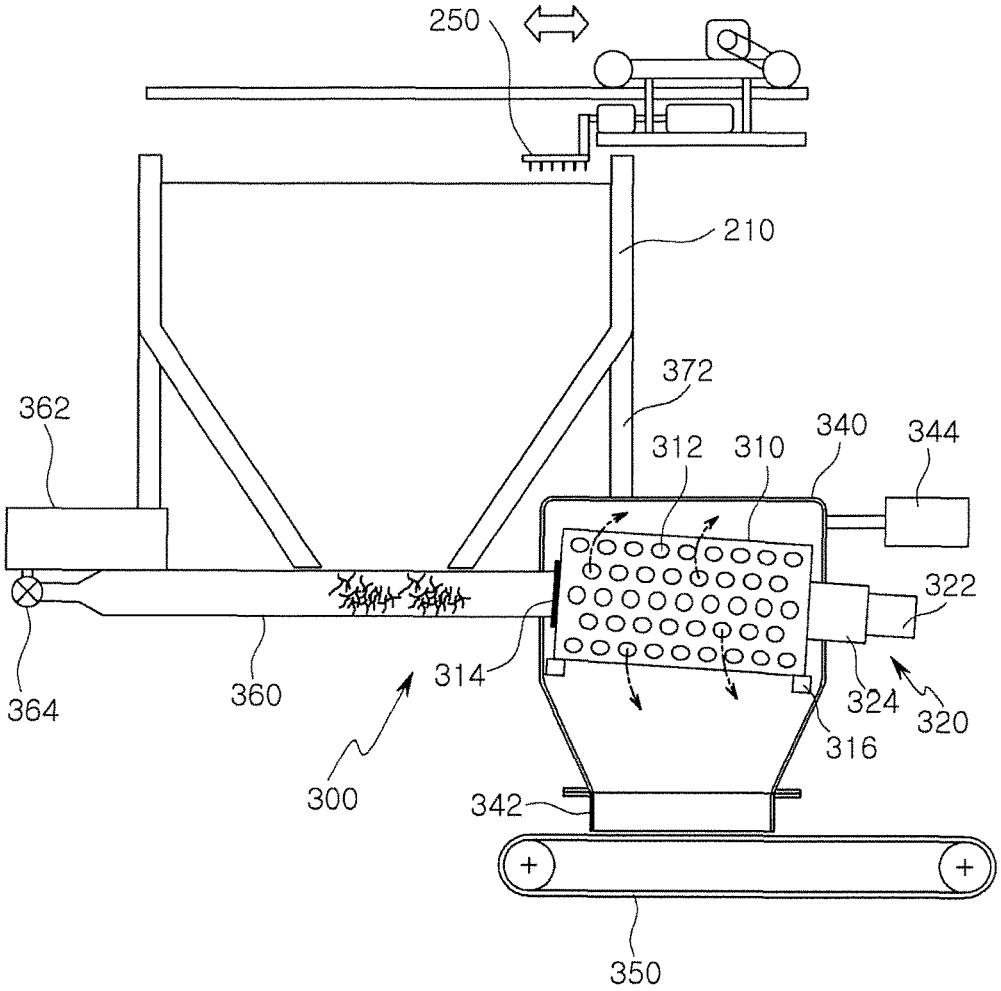

【Figure 18】
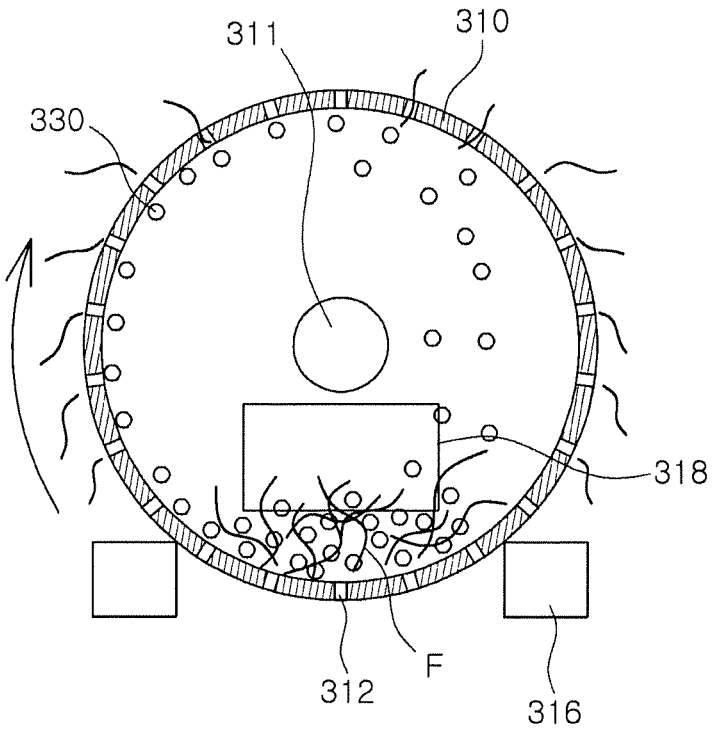

【Figure 19】
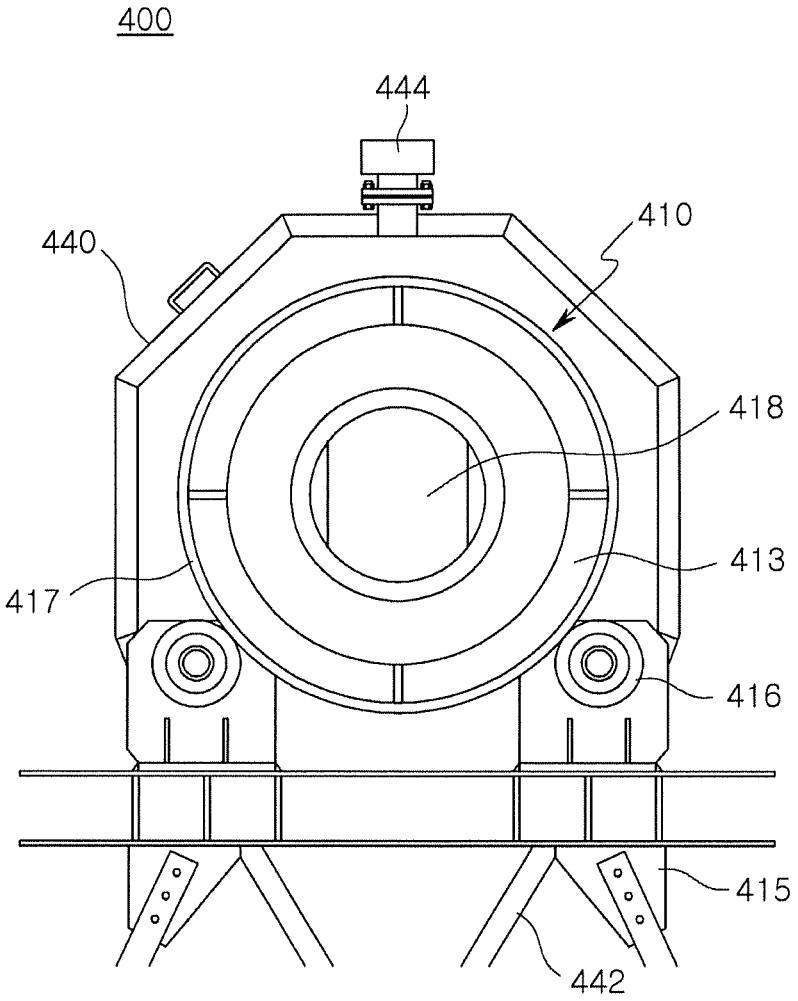

【Figure 20】
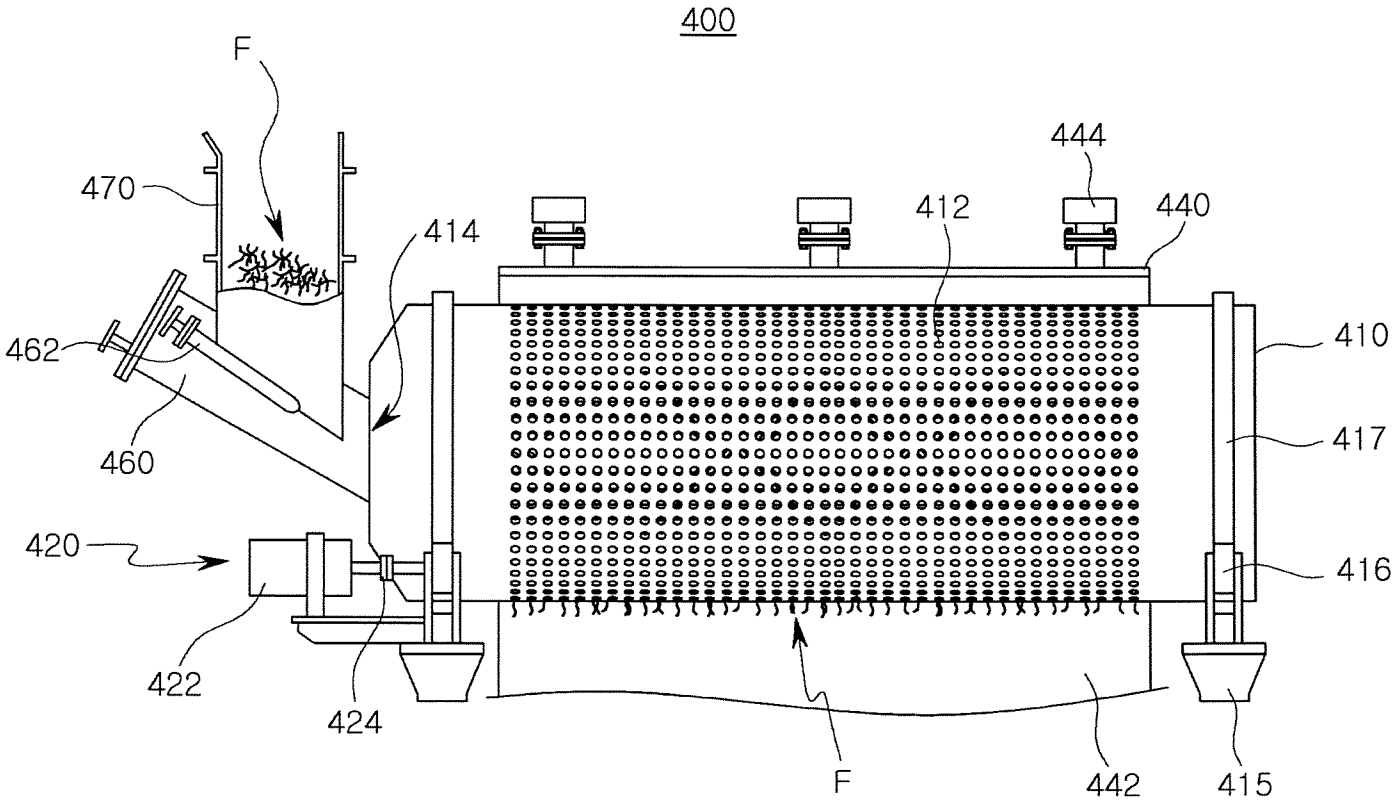

【Figure 21】
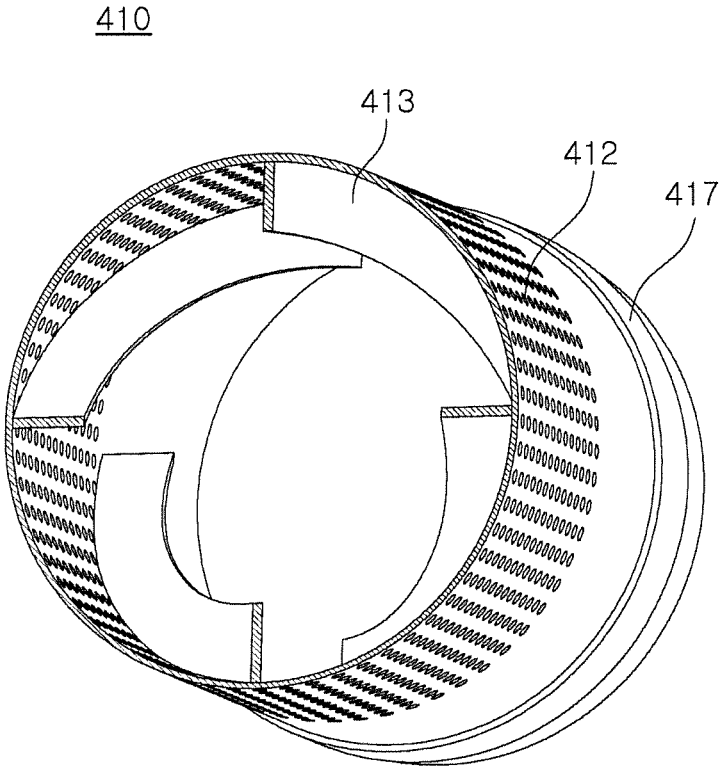

METAL FIBER MANUFACTURING SYSTEM

RELATED APPLICATIONS

This application is the U.S. National Phase under 35 U.S.C. § 371 of International Application No. PCT/KR2014/011641, filed on Dec. 1, 2014 which in turn claims the benefit of Korean Patent Application Nos. 10-2014-0091742, filed Jul. 21, 2014; 10-2014-0091743, filed Jul. 21, 2014; 10-2014-0113253, filed Aug. 28, 2014; 10-2014-0128266, filed Sep. 25, 2014; and 10-2014-0136073, filed Oct. 8, 2014, the disclosures of which applications are incorporated by reference herein.

TECHNICAL FIELD

The present disclosure relates to a metal fiber manufacturing system for stably supplying metal fiber to customers, and, more particularly, to a metal fiber manufacturing system configured to process metal fiber continuously or on a batch basis after the metal fiber is produced by casting, so as to improve the efficiency of production processes and economic benefits.

BACKGROUND ART

Information disclosed in this background-art section is only for providing background information about embodiments of the present disclosure and does not form the prior art.

For example, steel fiber may be used together with concrete to improve the strength of structures in civil engineering and construction. However, reinforcing materials using steel fibers may rust if exposed to moisture for a long time and thus may not be suitable as construction materials. To address this, amorphous fibers which do not rust and have improved strength have been produced.

After a casting process using a cooling wheel, manufacturing processes are required for mass production and commercialization of metal fibers such as amorphous fibers. Metal fiber produced through such a casting process is stored in large sacks, and, according to demand, the metal fiber is weighed on a scale, packed in bags in predetermined amounts, and delivered to consumers.

Such manufacturing processes after a casting process are manually performed. The reason for this is that manufacturing systems or equipment have not yet been developed because the metal fiber market is not yet sufficiently large, to a degree requiring automation of manufacturing processes.

Therefore, if metal fibers are mass-produced and sold, high labor costs may be incurred, and competitiveness may be lowered due to manual manufacturing processes.

Meanwhile, metal fiber stored in containers may tangle because of material characteristics and shapes of the metal fiber, and thus it may be difficult to take the metal fiber out of the storage containers. Furthermore, tangling of metal fiber may increase in proportion to the size of a storage container because of the weight of the metal fiber, and many problems may occur when fine and long metal fiber strands are discharged from a storage container.

DISCLOSURE

Technical Problem

An aspect of the present disclosure may provide a system for manufacturing metal fiber stably and economically.

Technical Solution

According to an aspect of the present disclosure, a metal fiber manufacturing system includes: a casting device configured to cast molten metal as metal fiber by ejecting the molten metal through a nozzle onto a cooling wheel rotating at a high speed; and a collection and separation device configured to collect the metal fiber and separate defective and normal products of the metal fiber from each other.

The collection and separation device may include: a guide chute connected to the casting device, the guide chute including an inlet to introduce the metal fiber therethrough and a first outlet and a second outlet to discharge the metal fiber therethrough; and a variable discharge part provided on a side of the guide chute to vary a discharge position of the metal fiber introduced through the inlet so as to discharge the metal fiber through the first outlet or the second outlet.

The metal fiber manufacturing system may further include: a storage device connected to the collection and separation device to store the metal fiber; and a discharge device configured to discharge the metal fiber from the storage device.

The discharge device may include: a scraper driving unit including a first driving unit and a scraper support shaft connected to the first driving unit; and a scraper coupled to the scraper support shaft and configured to receive driving power from the first driving unit so as to discharge the metal fiber by raking heaped strands of the metal fiber from an upper side.

The metal fiber manufacturing system may further include a cutting device configured to cut metal fiber.

The cutting device may include: a perforated drum having a cylindrical shape and including a plurality of penetration holes formed in a round sidewall to cut the metal fiber using the penetration holes; a driving unit connected to the perforated drum to rotate the perforated drum; and a cover enclosing at least a portion of the perforated drum and collecting the metal fiber cut and discharged via the penetration holes.

Advantageous Effects

As described above, according to the present disclosure, metal fiber produced by casting is processed continuously or on a batch basis to manufacture a metal fiber product, and thus the efficiency of production processes and economic benefits may be improved.

In addition, according to the present disclosure, defective metal fiber is separately discharged and reused as scrap, and thus manufacturing costs of metal fiber may be decreased.

Furthermore, according to the present disclosure, metal fiber may be easily packed in predetermined weights, and deviation from a reference weight may be reduced during a packing process.

DESCRIPTION OF DRAWINGS

FIG. 1 is a block diagram illustrating a metal fiber manufacturing system according to a first embodiment of the present disclosure.

FIG. 2 is a perspective view schematically illustrating a casting device illustrated in FIG. 1.

FIG. 3 is a view schematically illustrating a transfer and separation device illustrated in FIG. 1.

FIG. 4 is a block diagram illustrating a metal fiber manufacturing system according to a second embodiment of the present disclosure.

FIG. 5 is a cross-sectional view illustrating a state in which normal metal fiber is discharged from a collection and separation device illustrated in FIG. 4.

FIG. 6 is a cross-sectional view illustrating a state in which defective metal fiber is discharged from the collection and separation device illustrated in FIG. 4.

FIG. 7 is a cross-sectional view illustrating a state in which normal metal fiber is discharged from a collection and separation device according to another embodiment.

FIG. 8 is a cross-sectional view illustrating a state in which defective metal fiber is discharged from the collection and separation device according to another embodiment.

FIG. 9 is a cross-sectional view illustrating a discharge angle adjustment unit of the collection and separation device according to the other embodiment.

FIG. 10 is a cross-sectional view illustrating a state in which the angle of the discharge angle adjustment unit of the collection and separation device is varied according to the other embodiment.

FIG. 11 is a front view illustrating a discharge device illustrated in FIG. 4.

FIG. 12 is a bottom view illustrating a lifting base illustrated in FIG. 11.

FIG. 13 is a plan view illustrating the discharge device illustrated in FIG. 11.

FIG. 14 is a side view illustrating a scraper driving unit illustrated in FIG. 13.

FIG. 15 is a view illustrating an operational state of the scraper driving unit and a scraper illustrated in FIG. 11.

FIG. 16 is a front view illustrating an example of a cutting device illustrated in FIG. 4.

FIG. 17 is a side view illustrating the cutting device illustrated in FIG. 16.

FIG. 18 is a cross-sectional view illustrating an operation of a perforated drum illustrated in FIG. 16.

FIG. 19 is a cross-sectional view illustrating a cutting device according to another embodiment.

FIG. 20 is a cut-away view illustrating a lateral side of the cutting device according to another embodiment.

FIG. 21 is a cut-away view illustrating a perforated drum illustrated in FIGS. 19 and 20.

BEST MODE

Hereinafter, exemplary embodiments of the present disclosure will be described with reference to the accompanying drawings. When allocating reference numerals to elements in the drawings, like elements are denoted, if possible, with like reference numerals, even though the elements are illustrated in different drawings. Moreover, detailed descriptions related to well-known configurations or functions will be omitted in order not to unnecessarily obscure subject matters of the exemplary embodiments of the present disclosure.

Manufacturing System of First Embodiment

FIG. 1 is a block diagram illustrating a metal fiber manufacturing system according to a first embodiment of the present disclosure. Referring to FIG. 1, the metal fiber manufacturing system according to the first embodiment of the present disclosure includes: a casting device 10, configured to cast molten metal M as a metal fiber F by ejecting the molten metal M through nozzles 14 onto a cooling wheel 12 rotating at high speed; a collecting device 20, including at least one barrier wall to collect the metal fiber F in real time; and a transfer and separation device 30, configured to separate normal and defective products of the metal fiber F from each other while transferring the metal fiber F.

FIG. 2 is a perspective view schematically illustrating the casting device 10, illustrated in FIG. 1. For example, the casting device 10 may perform a rapid-cooling casting process in which molten metal M is ejected onto the cooling wheel 12, rotating at high speed, through the nozzles 14 so as to form an amorphous solid by rapidly cooling the molten metal M. Grooves 13 are formed in the cooling wheel 12 at constant intervals in a circumferential direction of the cooling wheel 12, so as to determine the shape of amorphous fiber at the moment when the amorphous fiber is produced by casting.

For mass production, the metal fiber F, produced using the casting device 10, is collected from the cooling wheel 12 and transferred to a packing device 80 in real time. According to the first embodiment of the present disclosure, these processes are continuously performed using a plurality of devices.

The collecting device 20 may include at least one barrier wall to guide the metal fiber F scattered from the cooling wheel 12, and collects the metal fiber F in the transfer and separation device 30 without dispersion. The barrier wall may be installed in the middle of a scattering path of the metal fiber F to guide the metal fiber F to the transfer and separation device 30.

In the early stage of casting, molten metal M may scatter to the collecting device 20 or the transfer and separation device 30 because of abnormal operation conditions, and thus the transfer and separation device 30 may be damaged by the molten metal M having a high temperature. Thus, scattered molten metal M is separately collected.

To this end, for example, a barrier device (not shown), formed of a metal or a refractory material, may be placed between the cooling wheel 12 and the collecting device 20 to block scattered molten metal M and allow the scattered molten metal M to freely fall into a scrap box (not shown).

If molten metal M starts to be normally cast and separated as the metal fiber F, the barrier device is removed, and the metal fiber F is collected in the collecting device 20 and sent to the transfer and separation device 30.

Meanwhile, fine particles of the metal fiber F or dust may float in the air around the collecting device 20, which includes the barrier wall to collect the metal fiber F produced by casting, and thus a dust collector may be used to remove such fine particles or dust. To this end, a housing (not shown) may be installed to at least partially surround the barrier wall of the collecting device 20 and the transfer and separation device 30, and a dust collector (not shown) may be disposed on one side of the housing to remove metal fiber particles or dust by suction and thus prevent environmental problems.

FIG. 3 is a view schematically illustrating the transfer and separation device 30 illustrated in FIG. 1. The transfer and separation device 30, for transferring the metal fiber F may, for example, include a transfer module such as a conveyor belt, and an enclosed passage may be used as a transfer route so as to prevent problems, such as a scattering and loss of the metal fiber F or an introduction of impurities, during the transfer of the metal fiber F.

In addition, the transfer and separation device 30 may include a plurality of transfer modules 32 and 34 arranged at different heights of two or more layers. In this case, the transfer module 34, being the lowest transfer module, height-wise, may be configured to rotate in both the forward and reverse directions. In addition, so as to separate a defective product from a satisfactory normal product, an end of the lowest transfer module 34 may be connected to a subsequent process for processing a normal product, and the other end of the lowest transfer module 34 may be connected to a process for collecting and storing a defective product.

For example, when defective metal fiber F, produced by casting, is being transferred, the lowest transfer module 34 may receive the defective product from the transfer module 32 and may rotate in the reverse direction, so as to transfer the defective product to a defective product collecting process. The collected defective product may be reused.

However, when a satisfactory normal product is being transferred, the lowest transfer module 34 may rotate in the opposite direction, that is, the forward direction, so as to transfer the normal product to a subsequent process.

As described above, a defective product may be produced in the early stage of casting because of abnormal operation conditions, and may also be produced in the final stage of casting for the same reason. Therefore, the transfer and separation device 30 may be rotated in the reverse direction at pre-set times. For example, the transfer and separation device 30 may be rotated in the reverse direction for about three to about five minutes in the early stage of casting and for about three to about five minutes just before the end of casting.

The transfer and separation device 30 may include only one transfer module, and in this case, the transfer module may be configured to rotate in both the forward and reverse directions, so as to separate normal and defective products from each other.

If the metal fiber F produced by casting is regularly cut into parts according to the intervals of the grooves 13 formed in the cooling wheel 12, an additional cutting device may not be used before a packing process. In most cases, however, not more than 80% of a product is cut. Thus, an additional cutting device may be used.

For this reason, the metal fiber manufacturing system of the first embodiment of the present disclosure may further include a cutting device 60 at the end of the transfer and separation device 30 transferring a satisfactory normal product, and non-cut metal fiber F may be cut using the cutting device 60.

A centrifugal-force cutting device (to be described later) may be used as the cutting device 60. However, the cutting device 60 is not limited thereto.

Metal fiber F which is continuously transferred and cut after casting may be transferred using a second transfer device 70 for a packing process.

In addition, the metal fiber manufacturing system of the first embodiment of the present disclosure may further include a packing device 80, configured to pack a separated normal metal fiber product in predetermined amounts.

Such metal fiber F may be temporarily stored in a measuring hopper of the packing device 80 and may be continuously packed in predetermined amounts. Packing devices for packing products in predetermined amounts are well known, and thus detailed descriptions of the configuration and operation of the packing device 80 will not be presented here.

Manufacturing System of Second Embodiment

FIG. 4 is a block diagram illustrating a metal fiber manufacturing system according to a second embodiment of the present disclosure. Referring to FIG. 2, the metal fiber manufacturing system according to the second embodiment of the present disclosure includes: a casting device 10, configured to cast molten metal M as the metal fiber F by ejecting the molten metal M through nozzles 14 onto a cooling wheel 12, rotating at high speed; and a collection and separation device 20', configured to collect the metal fiber F in real time after casting, and to separate normal and defective products of the metal fiber F from each other.

In the following description of the metal fiber manufacturing system of the second embodiment illustrated in FIG. 4, the same elements as those of the metal fiber manufacturing system of the first embodiment will not be described in detail.

The collection and separation device 20' is configured to separate normal and detective products of the metal fiber F produced by the casting device 10, while guiding discharge of the metal fiber F. A collection and separation device including a rotatable variable discharge part (to be described later) may be used as the collection and separation device 20'. However, the collection and separation device 20' is not limited thereto.

The metal fiber manufacturing system of the second embodiment of the present disclosure may further include a transfer device 30' for transferring the metal fibers F. The transfer device 30' may, for example, include a transfer module such as a conveyor belt, and an enclosed passage may be used as a transfer route for metal fiber so as to prevent problems such as the scattering and loss of the metal fiber F and an introduction of impurities.

A storage container may be used as a storage device 40. A normal product of the metal fiber F may be stored in the storage container, and, if necessary, the metal fiber F may be discharged from the storage container in predetermined amounts. According to the second embodiment of the present disclosure, processes are performed on a batch basis.

The metal fiber F may become tangled in the storage container because of material characteristics and shapes of the metal fiber F, and thus it may be difficult to discharge the metal fiber F from the storage container. Tangling of the metal fiber F may increase in proportion to the size of the storage container because of the weight of the metal fiber F.

A discharge device including a scraper (to be described later) may be used as a discharge device 50 so as to smoothly discharge the metal fiber F. However, the discharge device 50 is not limited thereto.

The metal fiber manufacturing system of the second embodiment of the present disclosure may also include a cutting device 60 at an end of the discharge device 50 through which a satisfactory normal product is discharged, so as to cut the metal fiber F that has not yet been cut.

A centrifugal-force cutting device (to be described later) may be used as the cutting device 60. However, the cutting device 60 is not limited thereto.

After cutting, the metal fiber F may be transferred by a second transfer device 70 for a packing process.

In addition, the metal fiber manufacturing system of the second embodiment of the present disclosure may further include a packing device 80, configured to pack a separated normal metal fiber product in predetermined amounts.

Hereinafter, examples of devices applicable to the metal fiber manufacturing systems of the embodiments of the present disclosure will be described in detail.

Collection and Separation Device

FIG. 5 is a cross-sectional view illustrating a state in which an example of the collection and separation device illustrated in FIG. 4 discharges normal metal fiber according to an embodiment, and FIG. 6 is a cross-sectional view illustrating a state in which the example of the collection and separation device discharges defective metal fiber according to the embodiment.

Referring to FIGS. 5 and 6, a collection and separation device 100 may be used to guide discharge of the metal fiber F manufactured by a casting device. Particularly, the collection and separation device 100 may be used to separate normal and defective products of the metal fiber F from each other.

As described above, the metal fiber F may be manufactured through a rapid-cooling casting process in which molten metal M is ejected through nozzles 14 and brought into contact with a cooling wheel 12, rotating at high speed, to be cooled rapidly.

The metal fiber F manufactured as described above may be supplied to the collection and separation device 100 of the embodiment. The collection and separation device 100 may include a guide chute 110 connected to the casting device configured to produce metal fiber.

An inlet 112 may be formed in a side of the guide chute 110 to introduce the metal fiber F, and a first outlet 114 and a second outlet 116 may be formed in another side of the guide chute 110 to discharge the metal fiber F.

A variable discharge part 130 may be provided on a side of the guide chute 110 so as to vary the discharge position of the metal fiber F introduced through the inlet 112 to the first outlet 114 or the second outlet 116. The variable discharge part 130 may vary the discharge direction of the metal fiber F introduced through the inlet 112 according to the type of the metal fiber F, so as to discharge the metal fiber F through the first outlet 114 or the second outlet 116.

The variable discharge part 130 may be positioned such that some of the metal fiber F introduced through the inlet 112, for example, normally manufactured metal fiber F, may be discharged through the first outlet 114, and the rest of the metal fiber F, for example, defective metal fiber F, produced under abnormal operation conditions, may be discharged through the second outlet 116.

In addition, the collection and separation device 100 may be connected to a storage container (not shown) or a transfer device 150, including a conveyor 152, in order to process the metal fiber F discharged through the first outlet 114.

The storage container may store the metal fiber F discharged through the first outlet 114, and if a predetermined amount of the metal fiber F is stored in the storage container, the storage container may discharge the predetermined amount of metal fiber F for a subsequent processing process.

In addition, the metal fiber F discharged through the first outlet 114 may be placed on the conveyor 152 of the transfer device 150, and the conveyor 152 may be moved, thereby continuously transferring the metal fiber F to a subsequent process. The transfer device 150 may function like the above-described transfer device 30'.

In addition, the transfer device 150 may include a cover 154, communicating with the first outlet 114 and covering the conveyor 152 such that dust such as metal particles included in the metal fiber F discharged through the first outlet 114 may not scatter while the metal fiber F is transferred.

In addition, the collection and separation device 100 may include a scrap storage unit 160, configured to store and discharge the metal fiber F, so as to handle the metal fiber F discharged through the second outlet 116.

As illustrated in FIG. 5, the metal fiber F discharged through the first outlet 114 may be normal metal fiber F manufactured under normal operation conditions of the casting device.

In addition, as illustrated in FIG. 6, the metal fiber F discharged through the second outlet 116 may be defective metal fiber F' containing molten iron scattered during an abnormal operation of the casting device, such as an early casting operation of the casting device. Such defective metal fiber F' may not be amorphous or may include metal fiber strands having inadequate lengths.

If defective metal fiber F' is discharged to the storage container through the first outlet 114, the defective metal fiber F' may cause problems such as mixing with normal metal fiber F, a need for additional separation work in a subsequent processing process, or damaging or breaking the conveyor 152 while being transferred on the conveyor 152. Thus, such defective metal fiber F' is separately discharged as scrap to the scrap storage unit 160 through the second outlet 116.

Separated metal fiber F', that is, metal fiber F' manufactured under abnormal operation conditions, is collected in the scrap storage unit 160 and may be discharged from the scrap storage unit 160 to a scrap processing process.

Although it is described that the second outlet 116 communicates with the scrap storage unit 160, the second outlet 116 may also communicate with a transfer device including a conveyor for processing scrap. However, defective metal fiber F' is not continuously discharged through the second outlet 116. The conveyor of the transfer device may be damaged by the defective metal fiber F'. Thus, defective metal fiber F' may be collected in the scrap storage unit 160 and may then be discharged.

In addition, each of the first outlet 114 and the second outlet 116 may have a decreasing cross sectional area so as to easily gather and discharge metal fiber. To this end, a first sloped discharge part 115 and a second sloped discharge part 117, each sloped to gradually decrease a discharge cross sectional area, may be respectively provided on lower portions of the first outlet 114 and the second outlet 116.

In addition, the variable discharge part 130 may include a blocking member 132, rotatably provided on a side of the guide chute 110. According to a rotation of the blocking member 132, the first outlet 114 may be opened, or the first outlet 114 may be closed and the second outlet 116 may be connected to the blocking member 132.

In addition, the rotation angle of the blocking member 132 may be adjusted using a first driving unit 134.

The variable discharge part 130 may rotate the blocking member 132 according to the state of the metal fiber F manufactured by the casting device. For example, if normal metal fiber F is introduced, the variable discharge part 130 may rotate the blocking member 132 to open the first outlet 114. However, if the metal fiber manufactured under abnormal operation conditions or scattered molten iron is introduced, the variable discharge part 130 may rotate the blocking member 132 to close the first outlet 114 so that the defective metal fiber F' or scattered molten iron may be separated from normal metal fiber F and may be directed to the second outlet 116 for a scrap processing process.

To this end, the first driving unit 134 may include a driving motor installed on the side of the guide chute 110 to rotate the blocking member 132.

In this case, the blocking member 132 may include a rotation shaft **132*a* on an end portion, and the rotation shaft 132*a* may be rotatably coupled to a rotation connection member such as a hinge or a shaft support bracket installed on an inner side of the guide chute 110**.

In addition, a driving shaft of the first driving unit 134 may be coupled to an end portion of the rotation shaft **132*a* using a coupling member, and thus the blocking member 132 may be rotated by operating the first driving unit 134**.

Although it is described that the first driving unit 134 includes a driving motor, the first driving unit 134 may include a speed adjustor or a chain connecting a driving shaft of the driving motor to the rotation shaft 132*a*. In addition, an actuator may be used as the first driving unit 134. For example, the actuator may include an operation rod coupled to an end of the blocking member 132 and a cylinder configured to extend or retract the operation rod, and, as the operation rod is extended or retracted by hydraulic pressure applied to the cylinder, the end of the blocking member 132 may be rotated, that is, the blocking member 132 may be rotated on the rotation shaft 132*a*.

When normal metal fiber F is supplied, the blocking member 132 of the variable discharge part 130 may be fully rotated upward so as not to interfere with the metal fiber F.

In the current embodiment, the blocking member 132 is moved upward so as not to interfere with the metal fiber F. However, a structure or operation for preventing interference between the blocking member 132 and the metal fiber F is not limited thereto. For example, the blocking member 132 may be fully lifted or rotated to the left or right so as to prevent interference with the metal fiber F.

FIG. 7 is a cross-sectional view illustrating a state in which the collection and separation device 100 discharges normal metal fiber F according to another embodiment, and FIG. 8 is a cross-sectional view illustrating a state in which the collection and separation device 100 discharges defective metal fiber F according to another embodiment.

Referring to FIGS. 7 and 8, during a casting process for producing the metal fiber F, the collection and separation device 100 may automatically determine the type of metal fiber F introduced through the inlet 112 and automatically operate the variable discharge part 130.

To this end, a control module 170 for controlling the variable discharge part 130 may be provided on a side of the guide chute 110.

The control module 170 may include an optical module 172 configured to capture images of the metal fiber F passing through the inlet 112 so as to determine the type of the metal fiber F. For example, a CCTV may be used as the optical module 172.

In addition, the control module 170 may include a control unit 174 configured to determine the type of the metal fiber F, using images captured with the optical module 172.

The control unit 174 may determine the type of the metal fiber F and generate an operation control signal for the variable discharge part 130, and the first driving unit 134 may be operated to adjust the rotation angle of the blocking member 132 according to the operation control signal.

FIG. 9 is a cross-sectional view illustrating a discharge angle adjustment unit 190 of the collection and separation device 100 according to the other embodiment of the present disclosure, and FIG. 10 is a cross-sectional view illustrating a state in which the angle of the discharge angle adjustment unit 190 of the collection and separation device 100 is varied, according to the other embodiment of the present disclosure.

Referring to FIGS. 9 and 10, the collection and separation device 100 may further include the discharge angle adjustment unit 190 provided on the guide chute 110 to adjust the falling angle of the metal fiber F.

That is, in the collection and separation device 100, the metal fiber F continuously introduced from the casting device collides with and rubs against the guide chute 110 and then falls. Therefore, the discharge angle adjustment unit 190 may be used to decrease the amount of impulse when the metal fiber F collides with the guide chute 110 and to adjust the falling position of the metal fiber F according to the rubbing angle and discharge it.

To this end, the discharge angle adjustment unit 190 may include a damping member 192, rotatably provided on a side of the guide chute 110. For example, the damping member 192 may include a rotation shaft on an end portion thereof, and the rotation shaft may be rotatably provided using a rotation connection member such as a hinge or a shaft support bracket installed on an inner side of the guide chute 110.

The damping member 192 may contact with the metal fiber F when the metal fiber F is discharged through the first outlet 114, and the discharge angle of the metal fiber F may be adjusted according to the rotation angle of the damping member 192. In addition, the discharge angle adjustment unit 190 may include a second driving unit 194 to adjust the rotation angle of the damping member 192. For example, an actuator installed on an outer side of the guide chute 110 may be used as the second driving unit 194.

The second driving unit 194 may include an operation rod 194*a*, coupled to a rear surface of the damping member 192, and a cylinder 194*b*, configured to extend and retract the operation rod 194*a*. As the operation rod 194*a* is extended or retracted by hydraulic pressure applied to the cylinder 194*b*, the damping member 192 may be rotated.

Therefore, when the second driving unit 194 of the discharge angle adjustment unit 190 is operated, the operation rod 194*a* may be extended or retracted by hydraulic pressure applied to the cylinder 194*b* to adjust the rotation angle of the damping member 192, and thus the position to which the metal fiber F falls may be adjusted.

Discharge Device

FIG. 11 is a front view illustrating an example of the discharge device illustrated in FIG. 4, and FIG. 12 is a bottom view illustrating a lifting base 220 illustrated in FIG. 11.

Referring to FIGS. 11 and 12, according to an embodiment of the present disclosure, a discharge device 200 includes: a scraper driving unit 240, including a first driving unit and scraper support shafts 242 connected to the first driving unit; and a scraper 250, coupled to the scraper support shafts 242 and configured to receive driving power from the first driving unit to rake heaped metal fiber strands from an upper side and discharge the metal fiber strands.

The discharge device 200 of the embodiment of the present disclosure may be installed above a storage container 210 containing a plurality of strands of the metal fiber F, and the storage container 210 may be installed on a frame 211 provided under the storage container 210. The storage container 210 may function as the above-described storage device 40.

In addition, the storage container 210 includes upright wall members 212 and 213, defining an accommodation space, and the lifting base 220, configured to move upward and downward inside the wall members 212 and 213. The wall member 213 may be lower than the other wall member 212 to form an exit.

The lifting base 220 may include a base plate member 221 and a second driving unit coupled to the base plate member 221, to lift or lower the base plate member 221 along the wall members 212 and 213.

The second driving unit includes: screw jacks 223, attached to a lower surface of the base plate member 221 and including screw rods 222; first screw arms 225, interacting with the screw rods 222 via first screw couplings 224; and a second motor 227, configured to rotate the first screw arm 225.

The screw jacks 223, the first screw couplings 224, and the first screw arms 225 may be four in number, so as to uniformly distribute a load. In the second driving unit, illustrated in FIGS. 11 and 12 according to an embodiment, one second motor 227 is used to operate four screw jacks 223 for lifting or lowering the lifting base 220.

However, the embodiment is a non-limiting example. For example, four assemblies, each including a pair of a second motor 227 and a screw jack 223 may be used to lift and lower the lifting base 220, and, in this case, the first screw arms 225 may be omitted. The screw rods 222 of the screw jacks 223 may extend along the frame 211.

Alternatively, the second driving unit may be simply constructed using hydraulic or pneumatic cylinders including extendable cylinder rods.

Referring back to FIG. 12, a plurality of first screw arms 225 are used, and first screw couplings 224 may be located on both ends of the first screw arms 225. In addition, a plurality of first screw arms 225 may be connected to one screw rod 222, and one first screw coupling 224 may be used for one screw rod 222.

Each of the first screw couplings 224 may include a worm and a worm wheel or may include a pair of bevel gears, and may be fixed to the frame 211 or the storage container 210, directly or indirectly, via a bracket.

As illustrated in FIG. 12, when four screw jacks 223 are operated using one second motor 227, a first driving coupling 226 may be provided between the second motor 227 and one of the first screw arms 225. In this case, the first driving coupling 226 may also include a worm and a worm wheel or a pair of bevel gears.

The second motor 227 is rotatable in both the forward and reverse directions and is installed on the frame 211 or on an additional bracket (not shown) at a position under the storage container 210.

Thus, as the second motor 227 is rotated, the first screw arms 225 are rotated, and then the screw rods 222, interacting with the first screw arm 225, are rotated, thereby lifting or lowering the screw jacks 223 relative to the first screw couplings 224. As a result, the base plate member 221, fixed to the screw jacks 223, is lifted or lowered by the rotation of the second motor 227.

If the lifting base 220 is lifted inside the storage container 210, a pile of the metal fiber F contained in the storage container 210 is lifted together with the lifting base 220 to a height at which the metal fiber F may be discharged through a lateral upper portion of the storage container 210.

Strands of the metal fiber F may be amorphous fiber strands having, for example, a thickness of several tens of micrometers (μm), a width of several millimeters (mm), and a length of several tens of millimeters (mm). However, embodiments of the present disclosure are not limited to amorphous metal fibers. For example, embodiments of the present disclosure may be applied to wires having fine and long shapes or having other shapes. The metal fiber F may be introduced into the storage container 210 through an opened upper side of the storage container 210 and accumulated in the storage container 210.

FIG. 13 is a plan view illustrating the discharge device 200 illustrated in FIG. 11, and FIG. 14 is a side view illustrating the scraper driving unit 240 illustrated in FIG. 13. As illustrated in FIGS. 13 and 14, the scraper driving unit 240 is installed above the storage container 210 at a distance from the storage container 210.

The scraper driving unit 240 further includes a support bracket 241, installed at a distance from an upper end of the storage container 210, so as to allow the scraper 250 to rotate, and the first driving unit is placed on the support bracket 241.

The first driving unit includes a first motor 247, and the scraper support shaft 242, of which an end is perpendicularly connected to a rotation shaft of the first motor 247, is spaced apart from a leading end of the support bracket 241.

An end of the scraper support shaft 242 is perpendicularly connected to the rotation shaft of the first motor 247, and the other end of the scraper support shaft 242 is bent and rotatably coupled to the scraper 250.

The scraper support shafts 242 may be provided as a pair so as to stably support the weight of the scraper 250, and, as illustrated in FIG. 11, 13, or 14, a second driving coupling 246, a second screw arm 245, a pair of second screw couplings 244, and a pair of auxiliary rotation shafts 249, may be used.

In detail, the second screw arm 245 interacts with the rotation shaft of the first motor 247 via the second driving coupling 246, and the auxiliary rotation shafts 249 interact with end portions of the second screw arm 245, respectively, via the second screw couplings 244. In addition, ends of the scraper support shafts 242 are perpendicularly connected to the auxiliary rotation shafts 249, respectively, and the other ends of the scraper support shafts 242 are bent and rotatably coupled to the scraper 250.

The second screw couplings 244 are located on both ends of the second screw arm 245. Each of the second screw couplings 244 may include a worm and a worm wheel or a pair of bevel gears and may be fixed to the support bracket 241.

Since the second screw arm 245 is connected to the pair of auxiliary rotation shafts 249, the pair of auxiliary rotation shafts 249 may be operated using the first motor 247. In this case, as described above, the second driving coupling 246 may be provided between the second screw arm 245 and the first motor 247, and the second driving coupling 246 may also include a worm and a worm wheel or a pair of bevel gears.

An end of the scraper support shaft 242 is perpendicularly connected to the rotation shaft of the first motor 247 or to the auxiliary rotation shaft 249, and the other end of the scraper support shaft 242 is coupled to the scraper 250 via rotation support member 243 (refer to FIG. 15). The rotation support member 243 may be mechanical elements such as bearings or bushes.

In the present disclosure and drawings, the scraper 250 is driven by rotating the first motor 247. However, embodiments of the present disclosure are not limited thereto. The scraper 250 may be driven by any other method as long as the scraper 250 is capable of raking the metal fiber F. For example, a plurality of hydraulic or pneumatic cylinders or a single hydraulic or pneumatic cylinder may be combined with link members so as to drive the scraper 250 forward and backward or left and right, and upward and downward.

A plurality of pins 251 are arranged on a lower surface of the scraper 250, and the scraper 250 is rotatably coupled to lateral sides of the scraper support shafts 242, using the rotation support members 243. The scraper 250 may be rotated while being maintained in a horizontal position.

FIG. 15 is a view illustrating an operational state of the scraper driving unit 240 and the scraper 250 illustrated in FIG. 11. As illustrated in FIG. 15, the second screw arm 245 is rotated by rotation of the first motor 247, and then the auxiliary rotation shafts 249 are rotated according to the rotation of the second screw arm 245, thereby rotating the scraper support shafts 242. As a result, the scraper 250, fixed to the scraper support shafts 242, is rotated by the rotation of the first motor 247.

If the first motor 247 is a unidirectional motor, the scraper 250 may be rotated in a circle, and if the first motor 247 is a bidirectional motor capable of rotating in both the forward and reverse directions, the scraper 250 may be moved like a swing or pendulum.

In this manner, the scraper 250 may be rotated around the first motor 247 or the support bracket 241 while being horizontally supported on the scraper support shafts 242.

Referring back to FIGS. 13 and 14, the discharge device 200 of the embodiment of the present disclosure may further include a scraper moving unit 230, reciprocating the scraper driving unit 240 and the scraper 250.

The scraper moving unit 230 includes: a pair of guide rails 231; a cart 233, movable along the guide rails 231; and a third driving unit, connected to the cart 233 to reciprocate the cart 233. The guide rails 231 are installed above the storage container 210 at a distance from the storage container 210, and the scraper driving unit 240 is supported by the cart 233 or the support bracket 241.

The cart 233 includes a plurality of wheels 232, and the third driving unit may include a third motor 237, configured to drive at least one of the wheels 232. A power transmission device 236, such as a belt and pulley or a chain and sprocket, may be provided between the third motor 237 and the wheels 232. The third motor 237 is rotatable in both the forward and reverse directions, and the cart 233 is reciprocated, that is, moved forward or backward along the guide rails 231, according to the rotation of the third motor 237.

In the example illustrated in FIG. 13, for distribution of a load, the scraper moving unit 230 includes a pair of guide rails 231, a cart 233 including a plurality of wheels 232, and a third driving unit including a third motor 237. However, the scraper moving unit 230 is not limited to the example. That is, the scraper moving unit 230 may be variously modified according to load conditions and design specifications.

The operation of the scraper moving unit 230 will now be simply described. After the metal fiber F is discharged from a certain region of the storage container 210 by rotating or swinging the scraper 250 using the first motor 247, the third motor 237 is operated to move the cart 233 a predetermined distance along the guide rails 231 installed above the storage container 210, and then the metal fiber F is discharged from another region of the storage container 210. As described above, the scraper driving unit 240 and the scraper 250 are moved together in a forward or backward direction, and the scraper 250 is rotated or swung by rotation of the first motor 247, so as to discharge the metal fiber F from a region of the storage container 210.

In addition, the discharge device 200 of the embodiment of the present disclosure may further include a control unit (not shown), wherein the first driving unit or the first motor 247 of the scraper driving unit 240, the second driving unit or the second motor 227 of the lifting base 220, and the third driving unit or the third motor 237 of the scraper moving unit 230 may be sequentially operated or varied in speed according to power applied by the control unit.

According to the related art, it is difficult to discharge fine and long metal fiber such as amorphous metal fiber from a storage container because the metal fiber tangles, due to material characteristics and shapes thereof, and tangling of metal fiber increases in proportion to the size of a storage container because of the weight of the metal fiber. According to the discharge device 200 of the embodiment of the present disclosure, however, stored metal fiber is sequentially discharged from an upper layer of the metal fiber, and thus the metal fiber may be continuously and uniformly discharged without trapping or overload situations caused by the weight or tangling of the metal fiber.

Cutting Device

FIG. 16 is a front view illustrating a cutting device 300 according to an embodiment of the present disclosure, and FIG. 17 is a side view illustrating the cutting device 300 illustrated in FIG. 16.

Referring to FIGS. 16 and 17, the cutting device 300 of the embodiment includes: a perforated drum 310, having a cylindrical shape and including a plurality of penetration holes 312 formed in a round sidewall; a driving unit 320, connected to the perforated drum 310 to rotate the perforated drum 310; and a cover 340, enclosing at least a portion of the perforated drum 310 for collecting the metal fiber F cut and discharged through the penetration holes 312.

The perforated drum 310 has a barrel shape such as a cylindrical shape, and an inlet 314 having an inner diameter smaller than the inner diameter of the perforated drum 310 is provided in a side of the perforated drum 310.

The penetration holes 312 formed in the round sidewall (that is, formed in a circumferential wall) have a function of discharging the metal fiber F introduced into the perforated drum 310 and a function of cutting the metal fiber F by rotational force of the perforated drum 310.

The diameter of the penetration holes 312 is about 0.5 to about 2 times the length of cut strands of the metal fiber F. If the diameter of the penetration holes 312 is less than 0.5 times the length of strands of the metal fiber F, it may be difficult to discharge the cut metal fiber F through the penetration holes 312. On the contrary, if the diameter of the penetration holes 312 is greater than twice the length of strands of the metal fiber F, strands of the metal fiber F that are not cut may easily pass through the penetration holes 312, and thus the efficiency of cutting may decrease.

As illustrated in FIG. 17, the perforated drum 310 is slightly inclined from the horizontal such that the perforated drum 310 may lower from the inlet 314 to the opposite side. Since the metal fiber F is introduced into the perforated drum 310 at a slightly reduced velocity but with increased downward kinetic energy, the metal fiber F may be smoothly introduced and moved downward and may not be easily moved in a reverse direction.

Both lengthwise sides of the perforated drum 310 are rotatably supported by support members 316, such as bearings or idle rollers installed on a support frame (not shown). In addition, a door 318 (refer to FIG. 18) is provided on a sidewall of the perforated drum 310, opposite the inlet 314, and operations such as a maintenance operation may be performed after opening the door 318.

One or more cutting members 330 (refer to FIG. 18) such as one or more metallic balls or pins, may be placed in the perforated drum 310 to cut the metal fiber F by beating the metal fiber F with the cutting members 330. When the perforated drum 310 is rotated, the cutting members 330, such as balls or pins may be randomly moved in the perforated drum 310 by rotational force of the perforated drum 310, and thus the metal fiber F introduced into the perforated drum 310 may be beaten and cut or broken by the cutting members 330. The cutting members 330 have a diameter or length greater than the diameter of the penetration holes 312. The cutting members 330 are not limited to balls or pins. That is, the cutting members 330 may have any other shapes.

For example, strands of the metal fiber F may be amorphous fiber strands having a thickness of several tens of micrometers (μm), a width of several millimeters (mm), and a length of several tens of millimeters (mm). However, embodiments of the present disclosure are not limited to amorphous metal fibers. For example, embodiments of the present disclosure may be applied to wires having fine and long shapes or other shapes.

If metal fiber F is amorphous, grooves, such as notches, may have been formed in the metal fiber F in a previous process. The metal fiber F may collide with the cutting members 330, such as balls or pins while being rotated in the perforated drum 310, and thus the metal fiber F may be fractured at the grooves and cut into certain lengths by the impact of collision.

Moreover, the metal fiber F may be introduced into the perforated drum 310 from a storage container 210 (to be described later) in a state in which the metal fiber F has become tangled in the storage container 210. In this case, since the metal fiber F is cut by collision with the cutting members 330, the metal fiber F may be untangled and easily separated.

The driving unit 320 includes a motor 322, and the motor 322 is connected to an end of a rotation shaft 311, aligned with a centerline of the perforated drum 310 so as to provide rotation power. For example, an inverter-driven motor may be used as the motor 322, so as to optimally control the speed of cutting by rotation. The rotation speed of the perforated drum 310 may be adjusted using the inverter-driven motor according to the amount of discharged metal fiber F or the cutting state. In addition, if necessary, a decelerator 324 may be provided between the motor 322 and the rotation shaft 311.

However, the driving unit 320 is not limited to these elements. For example, any other elements may be added to the driving unit 320.

For example, a driven pulley may be installed on an end portion of the rotation shaft 311 of the perforated drum 310, a driving pulley may be installed on an output shaft of the motor 322, and a power transmission belt may be wrapped around the driven pulley and the driving pulley to transmit driving power of the motor 322.

In another example, a friction member or a guide member may be attached to an outer surface of the perforated drum 310 along the circumference of the perforated drum 310, and the output shaft of the motor 322 may be connected to one of the support members 316, such as rollers installed on the support frame, so as to transmit the driving power of the motor 322.

FIG. 18 is a cross-sectional view illustrating an operation of the perforated drum 310 illustrated in FIG. 16. As the perforated drum 310 is rotated by driving power transmitted from the driving unit 320, the metal fiber F and the cutting members 330 contained in the perforated drum 310 are rotated together and moved upward along an inner wall of the perforated drum 310 by centrifugal force. If centrifugal force is overcome, while the cutting members 330 fall to a lower portion of the perforated drum 310, the cutting members 330 collide with the metal fiber F, and thus the metal fiber F is cut or broken.

In addition, while the metal fiber F is rotated along the inner wall of the perforated drum 310, the metal fiber F is discharged from the perforated drum 310 through the penetration holes 312 formed in the perforated drum 310 by centrifugal force. At this time, while the metal fiber F passes through the penetration holes 312, some of the metal fiber F which has not yet been cut may collide with and be cut by the penetration holes 312, owing to rotation of the perforated drum 310.

That is, since the perforated drum 310 or the penetration holes 312 have a function of cutting and discharging the metal fiber F, the metal fiber F may be uniformly discharged without clumping.

The cover 340 may enclose or seal at least a portion of the perforated drum 310. Owing to the cover 340, the metal fiber F, scattering after being cut and discharged through the penetration holes 312 of the perforated drum 310, may be easily collected and discharged downward. A skirt 342 may be provided on a lower portion of the cover 340 so as to smoothly discharge cut metal fiber F, and a conveyor 350 may be connected to the skirt 342. The conveyor may function like the above-described second transfer device 70.

In addition, when cut metal fiber F is discharged through the penetration holes 312 of the perforated drum 310, dust produced in the process of cutting the metal fiber F may also be discharged from the perforated drum 310. The dust may rapidly diffuse around the perforated drum 310 in the cover 340. Thus, a dust collector 344 may be connected or attached to an upper portion of a side of the cover 340 so as to collect dust discharged through the penetration holes 312 of the perforated drum 310.

The cutting device 300 of the embodiment of the present disclosure may be used after the metal fiber F is discharged from the storage container 210. Referring back to FIGS. 16 and 17, for example, if the metal fiber F is amorphous, even though the metal fiber F tangles in the storage container 210 because of the shape of the metal fiber F, the metal fiber F may be smoothly discharged from the storage container 210 by using the scraper 250 installed above the storage container 210.

Next, when the metal fiber F is discharged from an upper side of the storage container 210, the metal fiber F freely falls along a discharge guide 370 without any external physical force applied to the metal fiber F. A lower portion of the discharge guide 370 may communicate with a tube 360, configured to transfer the metal fiber F without tangling.

An end of the tube 360 is connected to the inlet 314 provided in the perforated drum 310 of the cutting device 300 of the embodiment, and the other end of the tube 360 is connected to an air blowing device 362, such as an air compressor, so as to transfer the metal fiber F in the tube 360 by blowing air to the metal fiber F. A control valve 364 may be provided between the tube 360 and the air blowing device 362 to allow air to flow or to block air flow.

The use of air may be helpful in transferring the metal fiber F, in easily untangling the metal fiber F in the perforated drum 310, and in smoothly discharging the metal fiber F from the perforated drum 310. Furthermore, as described above, since the perforated drum 310 is slightly inclined, air and the metal fiber F may be easily introduced into the perforated drum 310, and eddies may be present in the perforated drum 310. Thus, the metal fiber F may be more effectively separated and discharged The cutting device 300 of the embodiment may further include a control unit (not shown), wherein the motor 322 of the driving unit 320, the air blowing device 362, the control valve 364, and the dust collector 344 may be controlled or varied in speed according to power applied by the control unit.

The operation of the cutting device 300 of the embodiment will now be simply described. The metal fiber F contained in the storage container 210 is discharged to the discharge guide 370 by the scraper 250 and freely falls along the discharge guide 370. The metal fiber F falls into the tube 360, connected with the lower portion of the discharge guide 370, and is then moved into the perforated drum 310 by air blown into the tube 360 from the air blowing device 362.

The perforated drum 310 is rotated at a predetermined speed by rotational force transmitted from the motor 322 so as to cut the metal fiber F, using the cutting members 330 and the penetration holes 312 of the perforated drum 310. In addition, the cut metal fiber F is discharged through the penetration holes 312 owing to centrifugal force generated by the rotation of the perforated drum 310, and the cover 340 enclosing and sealing the perforated drum 310 collects the cut and scattered metal fiber F in the cover 340. The cut metal fiber F may be uniformly discharged to the conveyor 350, without clumping, through the skirt 342 provided on the lower portion of the cover 340.

At the same time, dust leaving the perforated drum 310 is removed using the dust collector 344 connected or attached to an upper portion of the cover 340.

According to the related art, it is difficult to discharge fine and long metal fiber such as amorphous metal fiber from a storage container because the metal fiber tangles, due to material characteristics and shapes thereof. Moreover, it is difficult to cut fine and long metal fiber into predetermined lengths and transfer the cut metal fiber to a conveyor for packing the cut metal fiber in given weights. According to the cutting device 300 of the embodiment, however, metal fiber may be continuously and uniformly transferred or discharged without tangling or clumping by transferring the metal fiber to the perforated drum 310 using air, easily cutting, untangling, separating the metal fiber using the cutting members 330 in the perforated drum 310, and discharging the metal fiber from the perforated drum 310 using centrifugal force generated by the rotation of the perforated drum 310.

FIG. 19 is a cross-sectional view illustrating a cutting device 400 according to another embodiment of the present disclosure; FIG. 20 is a cut-away view illustrating a lateral side of the cutting device 400; and FIG. 21 is a perspective view illustrating a perforated drum 410.

Referring to FIGS. 19 to 21, the cutting device 400 of the embodiment includes: a perforated drum 410, having a cylindrical shape, the perforated drum 410, including a plurality of penetration holes 412 formed in a round sidewall and one or more blades 413 extending inward from the sidewall; a driving unit 420, connected to the perforated drum 410 to rotate the perforated drum 410; and a cover 440, enclosing at least a portion of the perforated drum 410 for collecting the metal fiber F cut and discharged through the penetration holes 412.

The perforated drum 410 has a barrel shape such as a cylindrical shape, and an inlet 414 having a diameter smaller than the inner diameter of the perforated drum 410 is provided in a side of the perforated drum 410.

The penetration holes 412 formed in the round sidewall (that is, formed in a circumferential wall) have a function of discharging the metal fiber F introduced into the perforated drum 410 and of cutting the metal fiber F by rotation force of the perforated drum 410.

The diameter of the penetration holes 412 is about 0.5 to about 2 times the length of cut strands of the metal fiber F. If the diameter of the penetration holes 412 is less than 0.5 times the length of strands of the metal fiber F, it may be difficult to discharge the cut metal fiber F through the penetration holes 412. On the contrary, if the diameter of the penetration holes 412 is greater than twice the length of strands of the metal fiber F, strands of the metal fiber F that are not cut may easily pass through the penetration holes 412, and thus the efficiency of cutting may decrease.

In addition, as illustrated in detail in FIG. 21, the one or more blades 413 radially extending from the sidewall of the perforated drum 410 have a function of guiding and facilitating the introduction of the metal fiber F into the perforated drum 410 and of cutting the metal fiber F flowing in the perforated drum 410 by colliding with the metal fiber F as the perforated drum 410 rotates.

The blades 413 may be provided in a spiral shape on an inner circumferential surface of the sidewall of the perforated drum 410. Only one blade 413 or a plurality of separate blades 413 may be arranged in a length or width direction of the perforated drum 410. The blades 413 may have a length of about 2000 mm to about 3500 mm, a height of about 50 mm to about 200 mm, and a width of about 5 mm to about 20 mm. However, the dimensions, shape and arrangement of the blades 413 are not limited thereto. That is, the dimensions, shape and arrangement of the blades 413 may be varied to improve efficiency in cutting the metal fiber F.

In addition, one or more cutting members (not shown), such as one or more metallic balls or pins, may be placed in the perforated drum 410 to cut the metal fiber F by beating the metal fiber F with the cutting members. When the perforated drum 410 is rotated, the cutting members, such as balls or pins, may be randomly moved in the perforated drum 410 by rotational force of the perforated drum 410, and thus the metal fiber F introduced into the perforated drum 410 may be beaten and cut or broken by the cutting members. The cutting members have a diameter or length greater than the diameter of the penetration holes 412. The cutting members are not limited to balls or pins. That is, the cutting members may have any other shapes.

Although tangled metal fiber F is transferred to the perforated drum 410 from an arbitrary storage container, the metal fiber F may be easily untangled and separated while being cut in the perforated drum 410 or by the cutting members.

If the metal fiber F is amorphous, grooves, such as notches, may have been formed in the metal fiber F in a previous process. The metal fiber F may collide with the penetration holes 412, the blades 413, or the cutting members while being rotated in the perforated drum 410, and thus the metal fiber F may be fractured at the grooves and cut into certain lengths by the impact of collision.

Both lengthwise sides of the perforated drum 410 are rotatably supported by support members 416, such as bearings, wheels, or rollers installed on a support frame 415. Rails 417 may be provided along outer circumferential surfaces of both lengthwise sides of the perforated drum 410 so as to maintain contact with the support members 416 without separation from the support members 416.

In addition, a door 418 and hinges may be provided on a sidewall of the perforated drum 410 opposite the inlet 414, and operations, such as a maintenance operation, may be performed after opening the door 418.

The driving unit 420 includes a motor 422, and an output shaft of the motor 422 is connected to one of the support members 416, such as wheels or rollers installed on the support frame 415, so as to provide rotational power. For example, an inverter-driven motor may be used as the motor 422 so as to optimally control the speed of cutting by rotation. The rotation speed of the perforated drum 410 may be adjusted using the inverter-driven motor according to the amount of discharged metal fiber F or the cutting state. In addition, a coupling 424 may be used to connect the output shaft of the motor 422 to a rotation shaft of the support members 416.

However, the driving unit 420 is not limited to these elements. For example, any other elements may be added to the driving unit 420.

For example, the motor 422 may be connected to an end of a rotation shaft aligned with a centerline of the perforated drum 410 so as to provide rotation power. In addition, a driven pulley or sprocket may be attached to the above-mentioned end of the rotation shaft, and a driving pulley or sprocket may be attached to the output shaft of the motor 422. Then a power transmission belt may be wrapped around the driven pulley and the driving pulley, or a chain may be wrapped around the sprockets, so as to transmit driving power of the motor 422.

The cover 440 may enclose or seal at least a portion of the perforated drum 410. Owing to the cover, the metal fiber F, scattered after being cut and discharged through the penetration holes 412 of the perforated drum 410, may be easily collected and discharged downward. A skirt 442 may be provided on a lower portion of the cover 440 so as to smoothly discharge the cut metal fiber F, and a conveyor (not shown) may be connected to the skirt 442.

In addition, when the cut metal fiber F is discharged through the penetration holes 412 of the perforated drum 410, dust produced in the process of cutting the metal fiber F may also be discharged from the perforated drum 410. The dust may rapidly diffuse around the perforated drum 410 in the cover 440. Thus, a dust collector (not shown) may be connected or attached to at least one of ventilation holes 444 provided in an upper portion of the cover 440 so as to collect dust discharged through the penetration holes 412 of the perforated drum 410.

In addition, an end of a tube 460 may be connected to the inlet 414 provided in the perforated drum 410 of the cutting device 400 of the embodiment. As illustrated in FIG. 20, the tube 460 is connected to an outlet 470 of an arbitrary storage container.

The other end of the tube 460 may be connected to an air blowing device 462, such as an air compressor, to move the metal fiber F introduced into the tube 460 toward the perforated drum 410 by blowing air to the metal fiber F. A control valve may be provided between the tube 460 and the air blowing device 462 to allow air to flow or to block air flow.

The tube 460 is inclined from the horizontal such that a side of the tube 460 close to the inlet 414 of the perforated drum 410 may be relatively low in height. Thus, the metal fiber F may be smoothly introduced into the perforated drum 410, owing to downward kinetic energy, and may not be easily moved in a reverse direction.

The use of air may be helpful in introducing the metal fiber F, in easily untangling the metal fiber F in the perforated drum 410, and in smoothly discharging the metal fiber F from the perforated drum 410.

In detail, the metal fiber F is forced to flow into the perforated drum 410 by air blown from the air blowing device 462, and while being guided along the spirally arranged blades 413 in the perforated drum 410, the metal fiber F is forced to flow and collide with the penetration holes 412, the blades 413, or the cutting members, by rotational force of the perforated drum 410. Thus, the metal fiber F may be cut with high efficiency.

The cut metal fiber F may be discharged through the penetration holes 412 at a high rate, owing to air blown from the air blowing device 462. That is, discharge of the cut metal fiber F may be accelerated. In addition, since the cut metal fiber F is scattered in radial directions of the perforated drum 410 according to the rotation speed of the perforated drum 410 and due to air blown from the air blowing device 462, the cut metal fiber F may be more efficiently discharged.

The cutting device 400 of the embodiment may further include a control unit (not shown), wherein devices such as the motor 422 of the driving unit 420, the air blowing device 462, and the dust collector may be controlled or varied in speed according to power applied by the control unit.

Hereinafter, the operation of the cutting device 400 of the embodiment will be described.

Metal fiber F discharged from an arbitrary storage container and introduced into the tube 460 is transferred to the perforated drum 410 by air blown into the tube 460 from the air blowing device 462.

The perforated drum 410 is rotated at a predetermined speed by rotational force transmitted from the motor 422 so as to cut the metal fiber F using the penetration holes 412, the blades 413, or the cutting members. In addition, the cut metal fiber F is discharged through the penetration holes 412 owing to centrifugal force generated by the rotation of the perforated drum 410, and the cover 440 enclosing and sealing the perforated drum 410 collects the cut and scattered metal fiber F in the cover 340. At this time, while the metal fiber F passes through the penetration holes 412, some of the metal fiber F which has not yet been cut may collide with and be cut by the penetration holes 412, owing to rotation of the perforated drum 410.

The cut metal fiber F may be uniformly discharged, without clumping, through the skirt 442 provided on the lower portion of the cover 440. At the same time, dust leaving the perforated drum 410 may be discharged through the ventilation holes 444 provided in the upper portion of the cover 440, and may be collected by the dust collector connected or attached to the ventilation holes 444.

It is difficult to discharge fine and long metal fiber, such as amorphous metal fiber, because the metal fiber tangles due to material characteristics and shapes thereof. Moreover, it is difficult to cut fine and long metal fiber into predetermined lengths and pack the cut metal fiber in given weights. According to the cutting device 400 of the embodiment, however, the metal fiber F may be continuously and uniformly transferred or discharged, without tangling or clumping, by transferring the metal fiber to the perforated drum 410 using air, easily cutting, untangling, separating the metal fiber using the penetration holes 412, the blades 413, or the cutting members in the perforated drum 410, and discharging the metal fiber from the perforated drum 410 using centrifugal force generated by the rotation of the perforated drum 410.

While exemplary embodiments have been shown and described above, it will be apparent to those skilled in the art that modifications and variations could be made without departing from the scope of the present invention as defined by the appended claims. The exemplary embodiments of the present disclosure are for illustrative purposes only and are not intended to limit the scope of the present invention. Therefore, it should be understood that modifications, equivalents, and replacements made from the exemplary embodiments are within the scope of the present invention.

INDUSTRIAL APPLICABILITY

The embodiments of the present disclosure may be applied to metal fiber manufacturing processes for mass production and sale.

The invention claimed is:

1. A metal fiber manufacturing system comprising:

a casting device configured to cast molten metal as metal fiber by ejecting the molten metal through a nozzle onto a cooling wheel rotating at a high speed;

a collection and separation device configured to collect the metal fiber and separate defective and normal products of the metal fiber from each other; and a cutting device configured to cut the metal fiber, wherein the cutting device comprises:

a perforated drum having a cylindrical shape and comprising a plurality of penetration holes formed in a round sidewall to cut the metal fiber using the plurality of penetration holes;

a driving unit connected to the perforated drum to rotate the perforated drum; and a cover enclosing at least a portion of the perforated drum and collecting the metal fiber cut and discharged via the plurality of penetration holes.

2. The metal fiber manufacturing system of claim 1, wherein the collection and separation device comprises:

a guide chute connected to the casting device, the guide chute comprising an inlet to introduce the metal fiber therethrough and a first outlet and a second outlet to discharge the metal fiber therethrough; and a variable discharge part provided on a side of the guide chute to vary a discharge position of the metal fiber introduced through the inlet so as to discharge the metal fiber through the first outlet or the second outlet.

3. The metal fiber manufacturing system of claim 2, wherein the variable discharge part comprises:

a blocking member rotatably provided on the side of the guide chute so as to open the first outlet or close the first outlet while being connected to the second outlet; and a first driving unit configured to rotate the blocking member in response to introduction of the metal fiber.

4. The metal fiber manufacturing system of claim 2, further comprising a control module provided on a side of the guide chute to determine a type of the metal fiber when the metal fiber is introduced through the inlet and control the variable discharge part, wherein the control module comprises:

an optical module configured to capture images of the metal fiber when the metal fiber is introduced through the inlet; and a control unit configured to determine the type of the metal fiber using the images captured by the optical module and generate an operation control signal for the variable discharge part according to the determined type of the metal fiber.

5. The metal fiber manufacturing system of claim 2, further comprising a discharge angle adjustment unit provided on the guide chute to adjust a falling angle of the metal fiber, wherein the discharge angle adjustment unit comprises:

a damping member rotatably provided on a side of the guide chute and configured to make contact with the metal fiber when the metal fiber is discharged through the first outlet; and a second driving unit configured to adjust a rotation angle of the damping member.

6. The metal fiber manufacturing system of claim 1, further comprising:

a storage device connected to the collection and separation device to store the metal fiber; and a discharge device configured to discharge the metal fiber from the storage device.

7. The metal fiber manufacturing system of claim 6, wherein the discharge device comprises:

a scraper driving unit comprising a first driving unit and a scraper support shaft connected to the first driving unit; and a scraper coupled to the scraper support shaft and configured to receive driving power from the first driving unit so as to discharge the metal fiber by raking heaped strands of the metal fiber from an upper side.

8. The metal fiber manufacturing system of claim 7, wherein the first driving unit comprises a first motor, an end of the scraper support shaft is perpendicularly connected to a rotation shaft of the first motor, and an other end of the scraper support shaft is bent and rotatably coupled to the scraper.

9. The metal fiber manufacturing system of claim 8, wherein the scraper is rotated while being maintained in a horizontal position.

10. The metal fiber manufacturing system of claim 7, wherein the discharge device is provided above a storage container containing the strands of the metal fiber, wherein the storage container comprises:

an upright wall member defining a space for accommodating the metal fiber;

a base plate member placed inside the upright wall member; and a second driving unit connected to the base plate member to lift or lower the base plate member along upright the wall member.

11. The metal fiber manufacturing system of claim 10, wherein a side of the upright wall member is lower than other sides of the upright wall member.

12. The metal fiber manufacturing system of claim 7, further comprising a scraper moving unit configured to move the scraper driving unit and the scraper, wherein the scraper moving unit comprises:

a pair of guide rails;

a cart configured to move along the guide rails; and a third driving unit connected to the cart to reciprocate the cart, wherein the scraper driving unit is attached to the cart.

13. The metal fiber manufacturing system of claim 1, wherein a diameter of the plurality of penetration holes is 0.5 times to 2 times a length of strands of cut metal fiber.

14. The metal fiber manufacturing system of claim 1, wherein the perforated drum further comprises an inlet in a side thereof, an end of a tube is connected to the inlet, an other end of the tube is connected to an air blowing device, and the metal fiber is introduced into the perforated drum using air.

15. The metal fiber manufacturing system of claim 1, further comprising a packing device configured to pack the metal fiber in predetermined amounts.

16. A metal fiber manufacturing system comprising:

a casting device configured to cast molten metal as metal fiber by ejecting the molten metal through a nozzle onto a cooling wheel rotating at a high speed;

a collecting device comprising at least one barrier wall to collect the metal fiber;

a transfer and separation device configured to separate defective and normal products of the metal fiber from each other while transferring the metal fiber; and a cutting device configured to cut the metal fiber, wherein the cutting device comprises:

a perforated drum having a cylindrical shape and comprising a plurality of penetration holes formed in a round sidewall to cut the metal fiber using the plurality of penetration holes;

a driving unit connected to the perforated drum to rotate the perforated drum; and a cover enclosing at least a portion of the perforated drum and collecting the metal fiber cut and discharged via the plurality of penetration holes.

17. The metal fiber manufacturing system of claim 16, wherein the transfer and separation device comprises a transfer module operable in forward and reverse directions.

18. The metal fiber manufacturing system of claim 17, wherein the transfer module is operated in the reverse direction for a set period of time in an early stage and in a final stage of casting.

* * * * *